US011613858B2

(12) United States Patent
Ball

(10) Patent No.: US 11,613,858 B2
(45) Date of Patent: Mar. 28, 2023

(54) BARRIERS

(71) Applicant: ATG ACCESS LTD, Merseyside (GB)

(72) Inventor: Robert Nicholas Ball, Cheshire (GB)

(73) Assignee: ATG ACCESS LTD, Haydock (GB)

( * ) Notice: Subject to any disclaimer, the term of this patent is extended or adjusted under 35 U.S.C. 154(b) by 418 days.

(21) Appl. No.: 16/610,243

(22) PCT Filed: May 2, 2018

(86) PCT No.: PCT/GB2018/051170

§ 371 (c)(1),
(2) Date: Nov. 1, 2019

(87) PCT Pub. No.: WO2018/203052

PCT Pub. Date: Nov. 8, 2018

(65) Prior Publication Data

US 2020/0056339 A1 Feb. 20, 2020

(30) Foreign Application Priority Data

May 2, 2017 (GB) ..... 1706964

(51) Int. Cl.

| | |
|---|---|
| ***E01C 13/02*** | (2006.01) |
| ***E01F 13/02*** | (2006.01) |
| ***E01F 15/00*** | (2006.01) |

(52) U.S. Cl.
CPC ..... *E01F 13/02* (2013.01); *E01F 15/003* (2013.01)

(58) Field of Classification Search
CPC ..... E01F 13/02; E01F 15/003
USPC ..... 404/6, 9–11
See application file for complete search history.

(56) References Cited

U.S. PATENT DOCUMENTS

| | | | | |
|---|---|---|---|---|
| 1,574,908 | A | 3/1926 | Lamp | |
| 1,848,516 | A | 3/1932 | Davison | |
| 2,006,233 | A | 6/1935 | Chretien | |
| 2,263,649 | A | 11/1941 | Sawyer | |
| 3,810,595 | A | 5/1974 | Doolittle | |
| 3,861,097 | A | 1/1975 | Patterson | |
| 4,240,766 | A | 12/1980 | Halsey | |
| 4,576,508 | A | 3/1986 | Dickinson | |
| 4,752,152 | A * | 6/1988 | Crisp | E01F 13/123 404/6 |

(Continued)

FOREIGN PATENT DOCUMENTS

| | | |
|---|---|---|
| CH | 700218 | 7/2010 |
| CZ | 27308 | 9/2014 |

(Continued)

OTHER PUBLICATIONS

GB Combined Search and Examination Report corresponding to Application No. GB1214248.5 dated Aug. 29, 2012.

(Continued)

*Primary Examiner* — Raymond W Addie
(74) *Attorney, Agent, or Firm* — Niels Haun; Dann, Dorfman, Herrell & Skillman, P.C.

(57) ABSTRACT

Barriers, such as vehicle impact barriers for placing upon an existing surface such as a road surface, or a paved surface, or a pedestrian surface. Surface-mountable and removable barriers are described for use as vehicle impact barriers. Such barriers may be employed for rapid deployment in a street, causeway or other route.

15 Claims, 17 Drawing Sheets

(56) References Cited

U.S. PATENT DOCUMENTS

| | | | | |
|---|---|---|---|---|
| 4,792,258 | A * | 12/1988 | Goff | E01F 13/02 116/63 P |
| 4,844,653 | A | 7/1989 | Dickinson | |
| 4,919,563 | A | 4/1990 | Stice | |
| 4,973,189 | A | 11/1990 | Bechtold | |
| 5,248,215 | A | 9/1993 | Fladung | |
| 5,474,017 | A | 12/1995 | Mohebbi | |
| 5,481,828 | A | 1/1996 | Kentrotas | |
| 5,547,310 | A | 8/1996 | Muller | |
| 5,829,912 | A | 11/1998 | Marcotullio | |
| 5,975,792 | A | 11/1999 | Goeken | |
| 6,174,103 | B1 | 1/2001 | Stroman | |
| 6,435,760 | B1 | 8/2002 | Pettesch | |
| 6,626,606 | B1 | 9/2003 | Johnson | |
| 7,140,599 | B1 | 11/2006 | Spink | |
| 7,244,075 | B2 | 7/2007 | Stadler | |
| 7,264,417 | B1 * | 9/2007 | Nasatka | E01F 13/08 404/6 |
| 7,607,856 | B2 | 10/2009 | Patel | |
| 7,850,391 | B2 | 12/2010 | Omar | |
| 8,096,727 | B2 | 1/2012 | Parenti | |
| 8,197,156 | B2 | 6/2012 | Morgan | |
| 8,215,865 | B2 | 7/2012 | Adler | |
| 8,277,143 | B2 | 10/2012 | Adler | |
| 8,523,479 | B2 * | 9/2013 | Adler | E01F 13/12 404/6 |
| 9,038,299 | B1 * | 5/2015 | Uribe | E01F 13/02 40/610 |
| 10,140,894 | B2 * | 11/2018 | Woolstenhulme | G09F 7/18 |
| 2003/0051406 | A1 | 3/2003 | Ritz | |
| 2003/0145498 | A1 | 8/2003 | Venegas | |
| 2004/0091315 | A1 | 5/2004 | Yodock | |
| 2004/0151542 | A1 | 8/2004 | Johnson | |
| 2004/0159055 | A1 | 8/2004 | Stone | |
| 2005/0031411 | A1 | 2/2005 | Hensley | |
| 2005/0073275 | A1 | 4/2005 | Robb | |
| 2005/0098770 | A1 | 5/2005 | Schell | |
| 2006/0204327 | A1 | 9/2006 | Phelan | |
| 2006/0233608 | A1 | 10/2006 | Netah | |
| 2007/0031189 | A1 | 2/2007 | Stadler | |
| 2007/0086858 | A1 | 4/2007 | Morgan | |
| 2007/0258762 | A1 | 11/2007 | Stice | |
| 2007/0272911 | A1 | 11/2007 | Fromm | |
| 2008/0038056 | A1 | 2/2008 | Patel | |
| 2008/0038057 | A1 | 2/2008 | Stadler | |
| 2008/0112756 | A1 | 5/2008 | Omar | |
| 2008/0187396 | A1 | 8/2008 | Mccue | |
| 2009/0047066 | A1 | 2/2009 | Stice | |
| 2009/0202296 | A1 | 8/2009 | Lamore | |
| 2009/0208285 | A1 | 8/2009 | Adler | |
| 2009/0250674 | A1 | 10/2009 | Darcy | |
| 2010/0166498 | A1 | 7/2010 | Adler | |
| 2010/0290832 | A1 | 11/2010 | House | |
| 2011/0033232 | A1 | 2/2011 | Adler | |
| 2012/0177439 | A1 | 7/2012 | More | |
| 2012/0230764 | A1 | 9/2012 | Lafont | |
| 2012/0251236 | A1 | 10/2012 | Hild | |
| 2012/0308302 | A1 | 12/2012 | Adler | |
| 2013/0034387 | A1 | 2/2013 | Adler | |
| 2014/0003867 | A1 | 1/2014 | Ball | |
| 2014/0010591 | A1 | 1/2014 | Ball | |
| 2014/0017003 | A1 | 1/2014 | Ball | |
| 2014/0119825 | A1 | 5/2014 | Castro | |
| 2014/0147201 | A1 | 5/2014 | Ball | |
| 2014/0161521 | A1 | 6/2014 | Ball | |
| 2014/0161523 | A1 | 6/2014 | Ball | |
| 2018/0119373 | A1 * | 5/2018 | Neusch | E01F 13/08 |

FOREIGN PATENT DOCUMENTS

| | | | |
|---|---|---|---|
| DE | 2309249 | A1 | 8/1974 |
| DE | 3605747 | | 8/1987 |
| DE | 9316170 | | 2/1994 |
| DE | 9315671 | | 4/1994 |
| DE | 19631678 | | 2/1998 |
| DE | 19812116 | | 9/1999 |
| DE | 19815426 | | 10/1999 |
| DE | 202005013439 | | 11/2005 |
| DE | 102007052321 | A1 | 5/2009 |
| EP | 0176973 | A2 | 4/1986 |
| EP | 369860 | | 5/1990 |
| EP | 1530921 | | 5/2005 |
| EP | 1541768 | A1 | 6/2005 |
| EP | 2161377 | | 3/2010 |
| EP | 2306034 | | 4/2011 |
| FR | 002598484 | | 11/1987 |
| FR | 2621625 | | 4/1989 |
| FR | 2680190 | | 2/1993 |
| FR | 2686633 | | 7/1993 |
| FR | 002688244 | | 9/1993 |
| FR | 2721629 | | 12/1995 |
| FR | 2743097 | | 7/1997 |
| FR | 2759102 | | 8/1998 |
| FR | 2775992 | | 9/1999 |
| FR | 2785308 | | 5/2000 |
| FR | 2793821 | | 11/2000 |
| FR | 2814181 | | 3/2002 |
| FR | 28141181 | | 3/2002 |
| FR | 2851586 | | 8/2004 |
| FR | 2851587 | A1 | 8/2004 |
| FR | 2925080 | | 6/2009 |
| FR | 2929627 | | 10/2009 |
| FR | 2945300 | | 11/2010 |
| GB | 140262 | | 3/1920 |
| GB | 0997053 | | 6/1965 |
| GB | 1256889 | | 12/1971 |
| GB | 1426947 | | 3/1976 |
| GB | 2125084 | | 2/1984 |
| GB | 2178094 | A | 2/1987 |
| GB | 2267923 | | 12/1993 |
| GB | 2285826 | | 7/1995 |
| GB | 2372065 | | 8/2002 |
| GB | 2443631 | | 5/2008 |
| GB | 2467411 | | 8/2010 |
| GB | 2485278 | | 5/2012 |
| GB | 2487582 | | 8/2012 |
| GB | 2490118 | | 10/2012 |
| GB | 2493353 | | 2/2013 |
| JP | 2007016476 | | 1/2007 |
| JP | 2009097244 | A | 5/2009 |
| WO | 1997009485 | | 3/1997 |
| WO | 2004048702 | | 6/2004 |
| WO | 2004099534 | | 11/2004 |
| WO | 2007001326 | A2 | 1/2007 |
| WO | 2007008813 | | 1/2007 |
| WO | 2007018531 | A1 | 2/2007 |
| WO | 2007191977 | | 8/2007 |
| WO | 2007103394 | | 9/2007 |
| WO | 2009112159 | | 9/2009 |
| WO | 2010132616 | | 11/2010 |
| WO | 2010132616 | A1 | 11/2010 |
| WO | 2012101451 | | 8/2012 |
| WO | 2013017837 | | 2/2013 |
| WO | 2013033766 | | 3/2013 |
| WO | 2016030886 | | 3/2016 |
| WO | 2016069769 | | 5/2016 |

OTHER PUBLICATIONS

GB Combined Search and Examination Report corresponding to GB1214278.2 dated Dec. 10, 2012.

GB Search Report corresponding to Application No. GB1101514.6 dated May 27, 2011.

GB Search Report corresponding to GB1104802.2 dated May 25, 2012.

GB Search Report corresponding to GB1113211.5 dated Jan. 17, 2012.

International Search Report corresponding to PCT/GB2012/050173 dated May 22, 2012.

International Search Report corresponding to PCT/GB2012/050175 dated May 23, 2012.

(56) References Cited

OTHER PUBLICATIONS

International Search Report corresponding to PCT/GB2012/050176 dated May 21, 2012.
Search Report corresponding to Application No. GB1101513.8 dated May 26, 2011.
Written Opinion of the International Search Authority corresponding to PCT/GB2012/050173 dated May 22, 2012.
Written Opinion of the International Search Authority corresponding to PCT/GB2012/050175 dated May 23, 2012.
Written Opinion of the International Search Authority corresponding to PCT/GB2012/050176 dated May 21, 2012.
GB Combined Search and Examination Report corresponding to GB1214276.6 dated Mar. 19, 2013.
GB Examination Report corresponding to GB 1214276.6 dated Jul. 22, 2013.
GB Search Report corresponding to GB 1113203.2 dated Jan. 25, 2012.
GB Search Report corresponding to GB1109010.7 dated Sep. 16, 2011.
GB Search Report corresponding to GB1214276.6 dated Nov. 17, 2012.
International Search Report corresponding to Application No. PCT/GB2012/051755 dated Mar. 12, 2013.
International Search Report corresponding to PCT/GB2012/051198 dated Aug. 30, 2012.
Written Opinion of the International Searching Authority corresponding to PCT/GB2012/051198 dated Aug. 30, 2012.
Written Opinion of the International Searching Authority corresponding to PCT/GB2012/051755 dated Mar. 12, 2013.
Search Report with abstracts and figures dated Aug. 18, 2010.
Search Report with abstracts and figures dated Aug. 19, 2010.
Search Report with abstracts and figures dated Aug. 19, 2010—bis.
Search Report with abstracts and figures dated Aug. 20, 2010.
Search Report with abstracts and figures dated Oct. 2, 2010.
Search Report with abstracts and figures dated Mar. 23, 2015.
International Search Report corresponding to PCT/GB2018/051170 dated Aug. 23, 2018.
Search Report corresponding to Application No. GB 1706964.2 dated Sep. 21, 2017.
Further Search Report corresponding to Application No. GB 1706964.2 dated Oct. 18, 2019.
Further Search Report corresponding to Application No. GB 1706964.2 dated May 29, 2020.
Examination Report corresponding to Application No. GB 1706964.2 dated Oct. 18, 2019.

* cited by examiner

BARRIERS

PRIORITY APPLICATIONS

This application is a 371 application of International Application No. PCT/GB2018/051170 filed May 2, 2018, which claims priority to United Kingdom Patent Application No. 1706964.2 filed May 2, 2017. Each of the foregoing applications is hereby incorporated herein by reference.

FIELD

This invention relates to barriers, and particularly though not exclusively, to impact barriers such as vehicle impact barriers for placing upon an existing surface such as a road surface, or a paved surface, or a pedestrian surface. The invention in some aspects relates to surface-mountable and removable barriers for use as vehicle impact barriers. The invention may be employed for rapid deployment in a street, causeway or other route.

BACKGROUND

The provision of barriers comprising bollards, particularly vehicle barriers, often requires the permanent fixture, embedding or foundation of bollards within a ground surface in order to provide sufficient robustness and resilience of permanency to the barrier. It is very common that bollards arrayed collectively to provide such a barrier on a ground surface require some degree of excavation into that ground surface to enable each individual bollard of the barrier to be firmly, fixedly and permanently set into the ground to be upstanding from it. This is costly, time consuming and damaging to existing ground surfaces. For example an existing ground surface may comprise a paved area or may comprise a floor surface which is not in immediate contact with the ground, such as an elevated floor surface (e.g. a concrete floor) within an upper level of a building such as a car park or airport terminal building or the like. Excavating such a floor surface in order to accommodate embedded bollards is extremely undesirable. Structural integrity maybe compromised and the embedding of suitably robust bollards may not be feasible or permissible.

These problems are compounded when the situation requires rapid, but only temporary placement of a barrier. In those circumstances, time-consuming placement followed by subsequent re-excavation of the embedded barrier would be required in order to remove the barrier.

The present invention aims to provide means and methods which may be used desirably to assist in addressing some or all of the problems identified above.

SUMMARY

In a first aspect, the invention may provide a vehicle barrier apparatus comprising: one or more barrier members; a plurality of separate support members each adapted for ground engagement by placement upon a ground or floor surface, and at least one of which includes at least one barrier member; at least one coupling member passing from at least one said support member to at least one other said support member thereby to couple separate said support members such that vehicular impact forces inducing movement in one coupled support member are transmissible to another coupled support member via the at least one coupling member; wherein a said coupling member comprises two separated link portions joined by a rigid joining portion therebetween, whereby each one of the two link portions is coupled therethrough to a respective one of said two coupled support members.

The coupling member may be articulated where the rigid joining portion connects to one or each said link portion.

The coupling member may comprise three chain links in a chain of which each said through-hole portion is provided by a respective one of the terminal two links in the chain, and the rigid joining portion comprises the one intermediate link in the chain.

The coupling member may be a substantially rigid body.

The coupling member may comprise a rigid plate through the face of which through-holes pass defining respective said link portions.

The coupling member may be coupled to the support member at a terminal edge of the support member. The coupling member may be coupled to opposing terminal edges of each of the two support members it is coupled to, and couples together. The opposing terminal edges of the two coupled support members may be coupled to one another by a plurality of separate coupling members of equal length enabling the opposing terminal edges to be disposed in parallel position. The one or more coupling members may be pivotably connected to such opposing terminal edges so as to be pivotable about an axis substantially parallel to a respective terminal edge. The length of a coupling member, or each coupling member of a plurality of members, may be not greater than: about 25%; or more preferably about 20%; yet more preferably about 15% of the length of either one of the two terminal edges it couples together. It has been found that this relatively close proximity of opposing terminal edges of coupled support members, as enforced by appropriately length coupling members described above, has the effect of placing a limit on the angle through which one support member may rotate/slide, when impacted by a vehicle, before the rotated terminal edge is caused to impact against an opposing terminal edge of the adjacent support member to which it is coupled. This reduces the extent to which the line of the barrier comprising a plurality of coupled support members, can bend in response to an impacting vehicle and therefore increases the rate at which impact forces are transferred laterally along the barrier from one support member to other (e.g. all other) support members. The more support members can be involved in absorbing impact forces, and the quicker that they can become involved in that process during impact, the more effective the barrier has been found to be in use.

One or more of the support members may comprise no barrier member. Such a support member may serve as a spacer support member placed intermediate between two other support members and coupled to each. Such coupling may be as described above. The terminal edge by which the one or more coupling members couple the spacer support member to an adjacent support member is preferably the same length as the length of the opposing terminal edge of the adjacent support member. The length of a spacer support member, being the distance between opposite terminal edges of the spacer support member e.g. in a direction perpendicular to those terminal edges, may be less than the length of one of, or each of the support members in between which the spacer support member is coupled. The spacer support member provides a means of adjusting the length of the barrier and the spacing between barrier members. The properties of a spacer support member may be substantially as described above with respect to any other support member comprising a barrier member. This includes the interrelationship between the support member and the coupling member(s) by which the spacer support member is coupled to adjacent support members.

A part of a said coupling member may extend in spaced opposition over an opposing surface of one or each said support member coupled thereby, and may be pivotable about the through-opening in a direction transverse (e.g. substantially perpendicular direction) to the opposing surface and/or in a direction parallel to (e.g. across) the opposing surface. For example, when the coupling member comprises a substantially rigid body (e.g. a rigid plate), an area or face of the rigid body may be arranged to overlap an immediately adjacent opposing area, face or part of the support member to which the coupling member is coupled, with sufficient spacing therefrom to allow a limited pivoting movement relative to the support member to bring parts of the coupling member into abutment against opposing parts of the support member to prevent further such pivoting movement. In this way, a relatively loose fit between a coupling member and a support member to which it is coupled, allows the coupling member some "wiggle room" in its connection to the support member, and therefore in the coupling between support members. For example, a support member may comprise a tube (e.g. box-section) into which a link portion of the coupling member is inserted with the link portion in register with opposing through-openings in opposing walls of the tube, and a pivot axle (e.g. bolt, or pin) passing from one opposing through-opening to the other via the link portion. The diameter or width of the coupling member may be less than the diameter of width of the inner bore of the tube to enable the coupling member to loosely fit inside the tube. The link portions of the coupling member may loosely fit around the pivot axle. The coupling member may be shaped to reciprocally match the shape of the inner bore of the tube (e.g. the coupling member may be a tube, such as a box-section tube), to allow a loose but sympathetic fit of the former within the latter. For example, ratio (d/D) of the diameter ('d'; or equivalent lateral dimension) of the coupling member within the diameter ('D'; or equivalent lateral dimension) of the tube (e.g. box-section bore) is preferably less than about 0.98, more preferably less than about 0.95, or less than about 0.9, or within the range of about 0.98 to 0.9. This relative dimensioning allows the necessary amount (e.g. enough but not too much) "wiggle room" between the coupling member and the support member it couples. An advantage of a box-section arrangement of the coupling member is that opposing walls of the box section structure may each define a respective one of two coupling members integrally formed in parallel opposition to each other across the bore of the box section. That is to say, opposing walls of the box section may each comprise two separated link portions (e.g. through-openings) joined by a rigid joining portion therebetween (e.g. the portions of the respective wall extending between the link portions of that wall. This provides a particularly strong coupling structure which is easy to manufacture and to use.

The coupling member, or each coupling member, may be connected to respective support members it couples via a respective pivot member which passes through a link member of the coupling member and is connected to a support member thereby to connect the coupling member to the respective support member. For example, a pivot member may comprise a bolt, pin, rod, shaft, axle connected to a respective support member and passing through a respective one of the two link portions of the coupling member. This forms an axis passing through the link portion about which the coupling member may pivot. For example, a coupling member may comprise a rigid plate through the face of which through-holes pass defining respective link portions, and a pivot member may pass through a respective one of the two through-holes and be connected to the support member either side of the through-hole in question. This, of course, applies to each of the two through-holes of a coupling member and each of the two support members coupled by it.

In other examples, in which the coupling member comprises a chain of only three links, the terminal chain links provide the link portions of the coupling member and a respective pivot member passes through each terminal chain-link. The diameter of a pivot member may be less than the diameter of a link portion of a coupling member through which it passes, such as to form a loose fit therein. For example, the pivot member may be dimensioned to retain the coupling member in connection with a support member, but not to fix the spatial orientation of the coupling member relative to the support member. This allows an adjustability of the special orientation of the coupling member relative to the support member. This has been found to be very useful in allowing adjustability in the shape of the overall train of support members forming a barrier which may follow a non-planar ground surface (e.g. the camber of a road). For example, ratio (d/D) of the diameter ('d'; or equivalent lateral dimension) of the pivot member within the diameter ('D'; or equivalent lateral dimension) of the link portion (e.g. through-opening) is preferably less than about 0.98, more preferably less than about 0.95, or less than about 0.9, or within the range of about 0.98 to 0.9.

In a second aspect, the invention may provide a surface-mounted vehicle barrier apparatus comprising: one or more elongated barrier members pivotably connected to a support member to be moveable about a pivot axis located within the support member from a stowed position to a deployed position; wherein said support member is adapted for ground engagement by placement upon a ground or floor surface and a said barrier member is upwardly inclined relative to the support member and the ground surface when in said deployed position.

The one or more elongated barrier members may be linear.

The one or more elongated barrier members may terminate in a spike outwardly presented when said barrier member is in the deployed position.

The one or more elongated barrier members may be tubular or box-section in form.

The vehicle barrier apparatus may comprise a plurality of said elongated barrier members each independently pivotably connected to a said support member to be moveable independently about a respective pivot axis located within the support member from a stowed position to a deployed position.

The pivot axis may be located adjacent a longitudinal edge of the support member such that the barrier member extends therefrom in a direction over the support member towards an opposite longitudinal edge of the support member and terminates without extending over the opposite longitudinal edge when in the deployed position. The barrier member(s) may be detachably attachable to the support member. For example, the support member may comprise a barrier connector stub pivotingly connected to the support member so as to be povitable about said pivot axis, and adapted to disconnectably connect to a terminal lower end of the barrier member to pivotably connect the barrier member to the support member. The barrier connector stub may comprise an aperture, opening or bore part adapted to receive the terminal lower end of the barrier member inserted therein, or may comprise a lug part adapted to be received within an aperture, opening or bore part formed in the terminal lower end of the barrier member (e.g. which may be hollow and tubular), for insertion therein.

The barrier member may be shorter than the width of the support member.

The support member may comprise a recess adapted receive a said barrier member when in the stowed position.

The vehicle barrier apparatus may include a removable cover member detachably attachable to the support member and dimensioned to house the salient parts of the barrier member when in the deployed position.

The cover member may be a sacrificial cover formed from a material which is friable to reveal the barrier member housed within upon breakage.

The outer surface of the cover member may be shaped to permit the said cover member to fit within the reciprocally-shaped cavity space of another said cover member for stacking. The outer surface of the cover member may be tapered such that the sides thereof are inclined towards a common axis.

The vehicle barrier apparatus may comprise a ramp member pivotably connected to a support member to be moveable about a pivot axis substantially parallel to a longitudinal edge of the support member from a stowed position to a deployed position of ground engagement thereby to define a ramp surface extending from the ground surface to an upper surface of the support member.

The vehicle barrier apparatus described above according to the invention in its first aspect may also comprise the features of the invention described above in its second aspect.

In a third aspect, the invention may provide a vehicle barrier apparatus comprising: one or more barrier members; one or more support members adapted for ground engagement by placement upon a ground or floor surface, and at least one of which includes at least one barrier member; wherein at least one of the one or more support members includes a ground-insertion member extending transversely from a ground-engagement side of the one or more support members adapted for insertion into a pre-formed opening within said ground or floor surface when in a ground-engaging position.

The ground-insertion member is shaped to reciprocate the shape of the pre-formed opening. The ground-insertion member may be fixed (e.g. welded) to the support member from which it extends. The support member may comprise a through-opening through which the ground-insertion member extends outwardly from the ground-engagement side of the support member. The ground-insertion member may be attached or fixed (e.g. welded) to the support member via the through-opening (e.g. welded to/at the peripheral edge thereof). The ground-insertion member may be tubular (e.g. cylindrical or box-section), or may comprise a framework of tubular parts interconnected (e.g. welded) together to form a desired shape. The ground-insertion member may be formed from a metal, such as steel. The ground-insertion member may comprise one or more sheets of steel arranged to extend, in use, vertically downward from the ground-engagement side of the support member. The plane of the sheet may lie in the upright (e.g. vertical) plane, in use, extending transversely (e.g. perpendicular) to the line of the vehicle barrier—e.g. extending in a direction generally parallel to the expected direction of vehicle impact which is generally perpendicular to the line of the vehicle barrier.

The ground-insertion member may be arranged to abut at least one side (e.g. the side disposed to be facing generally towards an oncoming vehicle in the event of impact), or opposing sides, of the pre-formed opening internally when inserted therein.

The vehicle barrier apparatus described above according to the invention in its first aspect may also comprise the features of the invention described above in its third aspect. The vehicle barrier apparatus described above according to the invention in its second aspect may also comprise the features of the invention described above in its third aspect.

In a fourth aspect, the invention may provide a vehicle barrier apparatus for placement adjacent to a kerb or adjacent to two opposing kerbs therebetween, comprising: one or more barrier members; one or more support members adapted for ground engagement by placement upon a ground or floor surface, and at least one of which includes at least one said barrier member; a kerb-abutment member connected to at least one support member and extending laterally therefrom for placement alongside a kerb adjacent to a part of said ground or floor surface other than that over which the at least one support member extends in placement thereupon. In this way, the kerb-abutment member may be placed alongside a kerb in the sense of e.g. being close to the side of, or next to, the kerb. It may be alongside in the sense of being together with and in cooperation with the kerb. The kerb-abutment member may be elongated, such as linear, and may be shaped in the manner of a limb, bar, rod or beam. The term 'kerb' is intended to include a reference to an edging to a pavement or raised path, as well as to street furniture or street/road-side structures forming kerb-like shapes (e.g. the base of a wall where it meets a path, pavement or street surface). A strut, or struts, may connect a support member and a kerb-abutment member. The strut may extend from a rear side of a support member, opposite to the side (e.g. front) of the vehicle barrier intended/arranged to receive vehicular impact, to connect with a kerb-abutment member at a location thereupon at the rear of the vehicle barrier.

The vehicle barrier apparatus may include two said kerb-abutment members each connected to a respective support member at opposite terminal ends of the vehicle barrier apparatus for placement alongside a respective one of two opposing kerbs. The kerb-abutment member may extend along at least a part of a terminal edge of the support member, and may extend along the whole of the terminal edge. This is in addition to extending laterally from the support member, at that terminal edge.

The kerb-abutment member may extend laterally in opposite directions from the support member for placement alongside a kerb extending at opposite sides of the support member.

The kerb-abutment member may be detachably attachable to the support member. The kerb-abutment member may be coupled, or attached/connected to the support member at the aforesaid terminal edge of the respective support member.

The kerb-abutment member may comprise a linear tube (e.g. box-section) of rigid material (e.g. steel).

The kerb-abutment member may comprise a ground-insertion member extending transversely from the kerb-abutment member (or each individually), and adapted for insertion into a pre-formed opening within said ground or floor surface from a ground-facing side of the kerb-abutment member when the kerb-abutment member extends alongside a kerb. The ground-insertion member may extend from a part of the kerb-abutment member which is not also alongside the support member to which the kerb-abutment member is attached. In this way, the ground-insertion member may extend from a part of the kerb-abutment member which is be laterally displaced from the support member. This permits insertion into a pre-formed hole in parts of the ground surface to the rear or fore-area of the vehicle barrier. Alternatively, of in addition, the ground-insertion member may extend from a part of the kerb-abutment member which is also alongside the support member to which the kerb-abutment member is attached. The ground-insertion member may be attached to the kerb-abutment member, or may be attached to the/a support member, via a flexible line (e.g. chain, cable, wire, cord, rope, strap etc.).

The vehicle barrier apparatus described above according to the invention in its first aspect may also comprise the features of the invention described above in its fourth aspect. The vehicle barrier apparatus described above according to the invention in its second aspect may also comprise the features of the invention described above in its fourth aspect. The vehicle barrier apparatus described above according to the invention in its third aspect may also comprise the features of the invention described above in its fourth aspect.

In a firth aspect, the invention may provide a vehicle barrier apparatus for placement across a kerb comprising: one or more barrier members; two or more support members adapted for ground engagement by placement upon a ground or floor surface, and at least one of which includes at least one said barrier member; an intermediate member coupled between each of two of said support members cross a kerb from a lower said ground or floor surface upon which one of said two support member is placed to a higher said ground or floor surface upon which the other one of said two support members is placed; wherein the intermediate member is coupled to one or both of said two support members by at least one coupling member passing from at least one said support member to the intermediate member thereby to couple the respective support member to the intermediate member such that vehicular impact forces inducing movement in one coupled support member are transmissible to the other of said two coupled support member via the intermediate member.

The intermediate member may comprise a stepped surface for placement upon said lower said ground or floor surface and/or upon said higher said ground or floor surface, across a kerb. The intermediate member may comprise a stepped surface for placement upon said lower said ground or floor surface and upon an upper surface of said other of said two support members, across a kerb.

The intermediate member may comprise a stepped surface for placement upon said upper said ground or floor surface and upon an upper surface of said one of said two support members, across a kerb. The intermediate member may comprises a through-opening in said surface thereof for receiving a barrier member therethough to couple the intermediate member to the support member comprising the barrier member in question.

The coupling member may comprise two separated link portions joined by a rigid joining portion therebetween, whereby each one of the two link portions is coupled therethrough to the intermediate member and to a respective one of said two coupled support members.

The intermediate member may comprise a first sliding interface member connected to a first support member placed upon an upper ground surface, and a second sliding interface member connected to a support member placed upon a lower ground surface, in adjustably sliding abutment against the first sliding interface member adjacent to the kerb. One of the first sliding interface members and the second sliding interface members may comprise a plate disposed in an upright position for extending beyond the support member to which it is attached and vertically across a kerb to abut against an opposing other one of the first sliding interface member and the second sliding interface member. The first sliding interface member and/or the second sliding interface member may comprise one or more parallel vertical through-slots which extend through, and across, a respective abutment surface such that the/each slot is in register with a respective slot insert member passing therethrough. The slot insert member (e.g. a bolt. Pin. Or the like) is adapted to couple the first and second sliding interface members together via the slot(s). The first and second sliding interface members are slidingly moveable relative to each other in the direction constrained by said vertical slot(s).

The vehicle barrier apparatus described above according to the invention in its first aspect may also comprise the features of the invention described above in its fifth aspect. The vehicle barrier apparatus described above according to the invention in its second aspect may also comprise the features of the invention described above in its fifth aspect. The vehicle barrier apparatus described above according to the invention in its third aspect may also comprise the features of the invention described above in its fifth aspect. The vehicle barrier apparatus described above according to the invention in its fourth aspect may also comprise the features of the invention described above in its fifth aspect.

Components of any vehicle barrier described above, and herein, such as a barrier member and/or a support member, and/or a coupling member, and/or a kerb abutment member, and/or an intermediate member, and/or insertion member, may be formed from a metal such as steel (unless otherwise stated), and rigidly connected component parts may be welded together.

DESCRIPTION OF EMBODIMENTS

Figure 1:
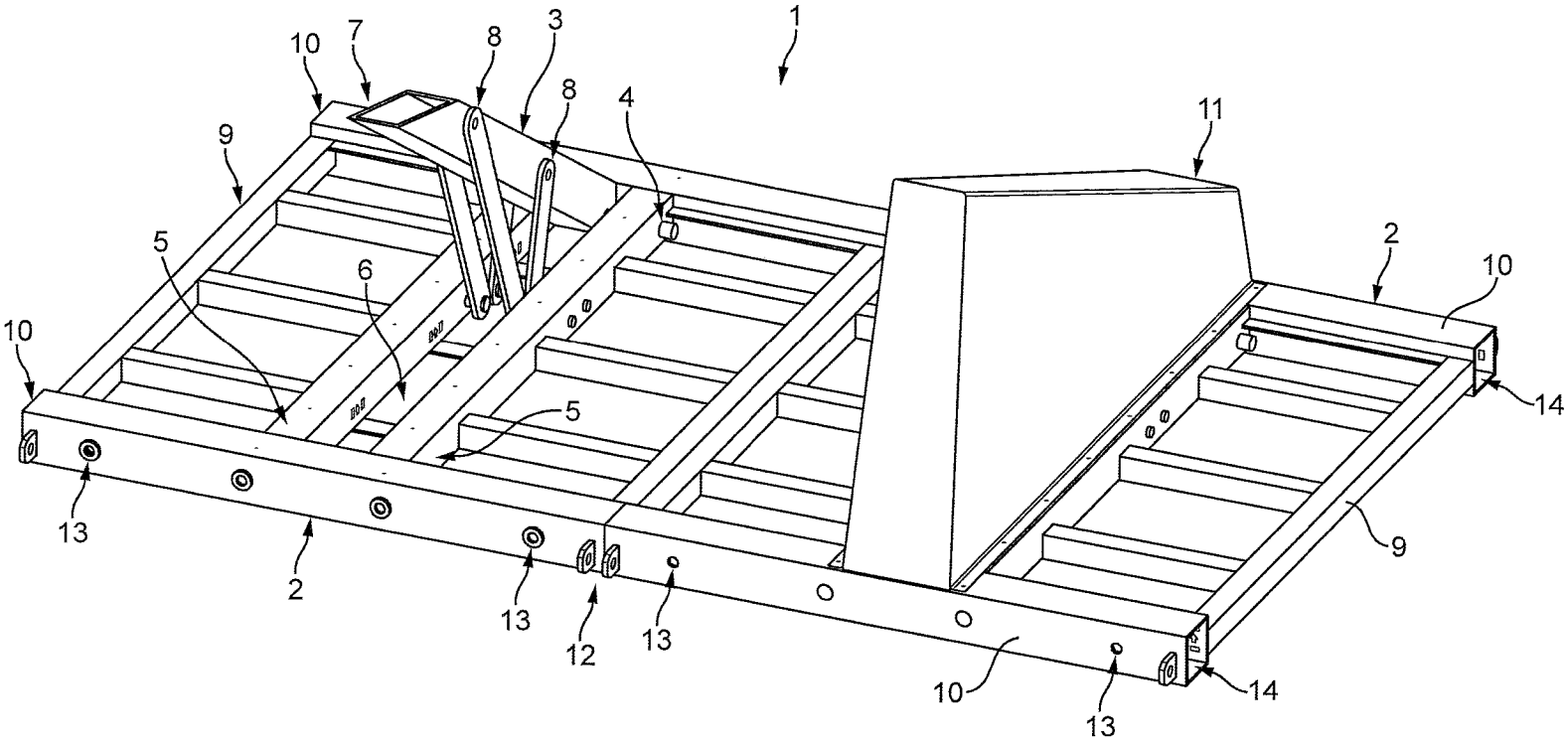
FIG. 1 illustrates a surface mounted vehicle barrier.

FIG. 1 shows a vehicle barrier apparatus (1) comprising two separate barrier members (3) each with a respective support member (2). Each support member is adapted for ground engagement by placement upon a ground or floor surface. Coupling members (15, FIG. 2) pass from one support member (2) the other support member thereby coupling the two separate support members where they meet (12). The coupling is such that vehicular impact forces inducing movement in one of these two coupled support members are transmissible to the other coupled support member via the coupling member. Each support member comprises a framework of box-section tubes (5, 9, 10 etc.) forming a substantially flat rectangular framework for placement upon a ground surface, in use. The barrier member (3) attached to a respective support member extends laterally across the support member from a location adjacent a rear edge of the framework in a direction towards the fore edge at the opposite side of that framework. The rear edge and the fore edge of the framework are each composed of a box-section beam (10), the one disposed to be substantially coplanar and parallel with the other and joined thereto by a first pair of parallel, spaced lateral cross-beams (5) centrally disposed in the framework which, themselves, are box-section in nature, and by a second pair of parallel-spaced lateral cross-beams (9) defining opposite terminal ends of the support member, and also being box-section in nature.

One terminal end of a support member is abutted against another terminal end of an adjacent support member, in-line, and with respective rear edges and fore edges in register, as part of a longitudinally-extending array of separate successive support members (with attendant barrier members, 3) as illustrated in FIG. 1. Successive such support members are coupled together by two separate coupling member inserts (15) which each extend from within the inner box-section bore (14) of a respective one of the two box-section tubes (10) forming the rear and fore edge (10) of support member framework, and into the inner box-section bore (14) of corresponding rear and fore edge box-section tubes of a neighbouring support member abutted in register.

Figure 2:
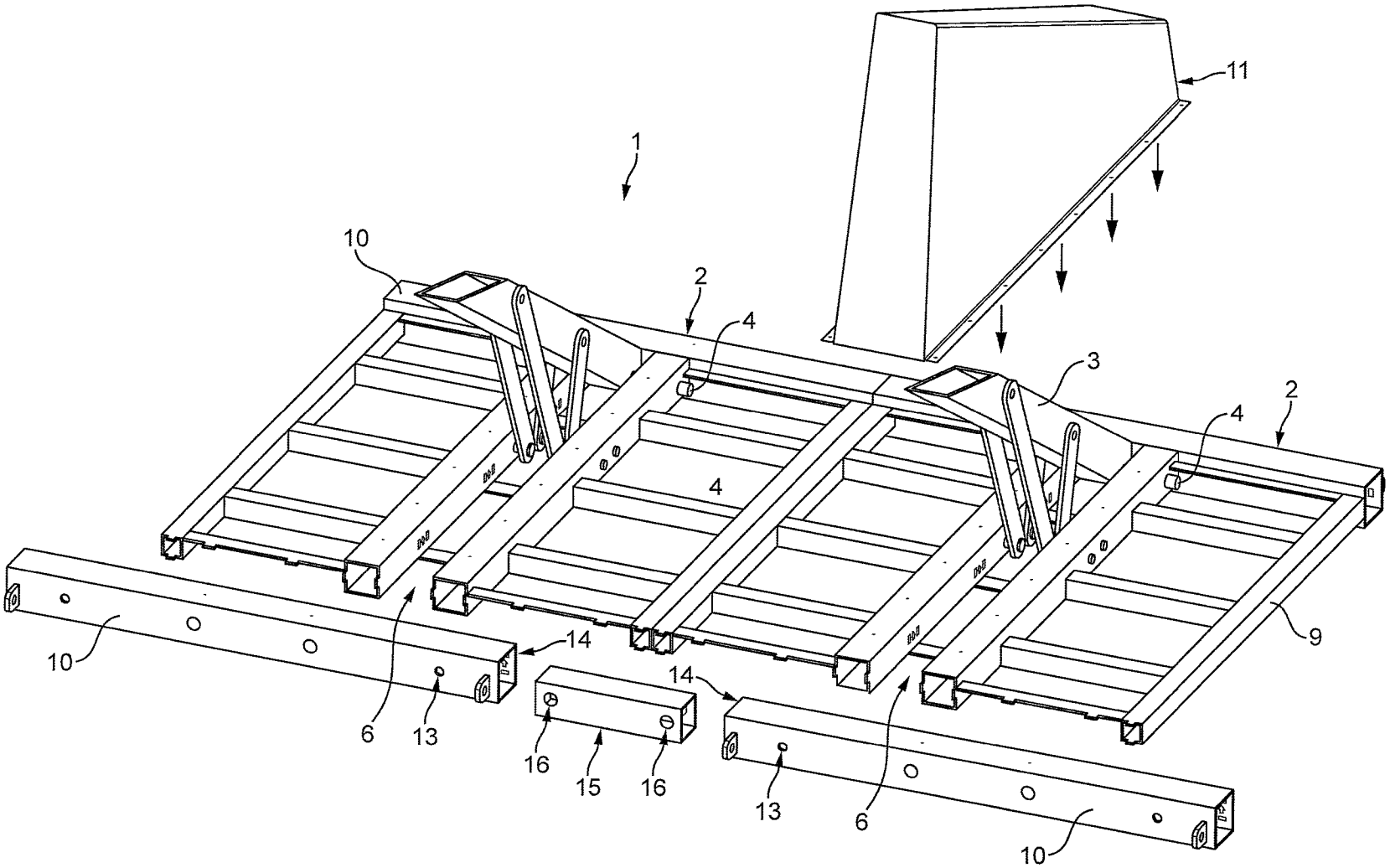
FIG. 2 illustrates an exploded view of FIG. 1.

FIG. 2 shows a partially exploded view of the barrier apparatus of FIG. 1, in which component parts of the two support members (2) of the barrier are separated to reveal one of these two coupling members (15) via which the two support members are coupled. The coupling member (15) comprises a first pair of two separated link portions (16) which are joined by a rigid joining portion between them. The link portions are, in this example, formed as through-openings (16) in the steel plate wall of a box-section tube insert (15), and the rigid joining portion is simply the continuous body of the steel plate of the box-section tube (15) extending between the two through-openings in that plate. An identical second pair of separated link portions are formed as through-openings (not shown) in the opposing steel plate wall at the other side of the box-section tube insert (not shown), and these link portions are in register with the first pair of link portions.

Figure 15:
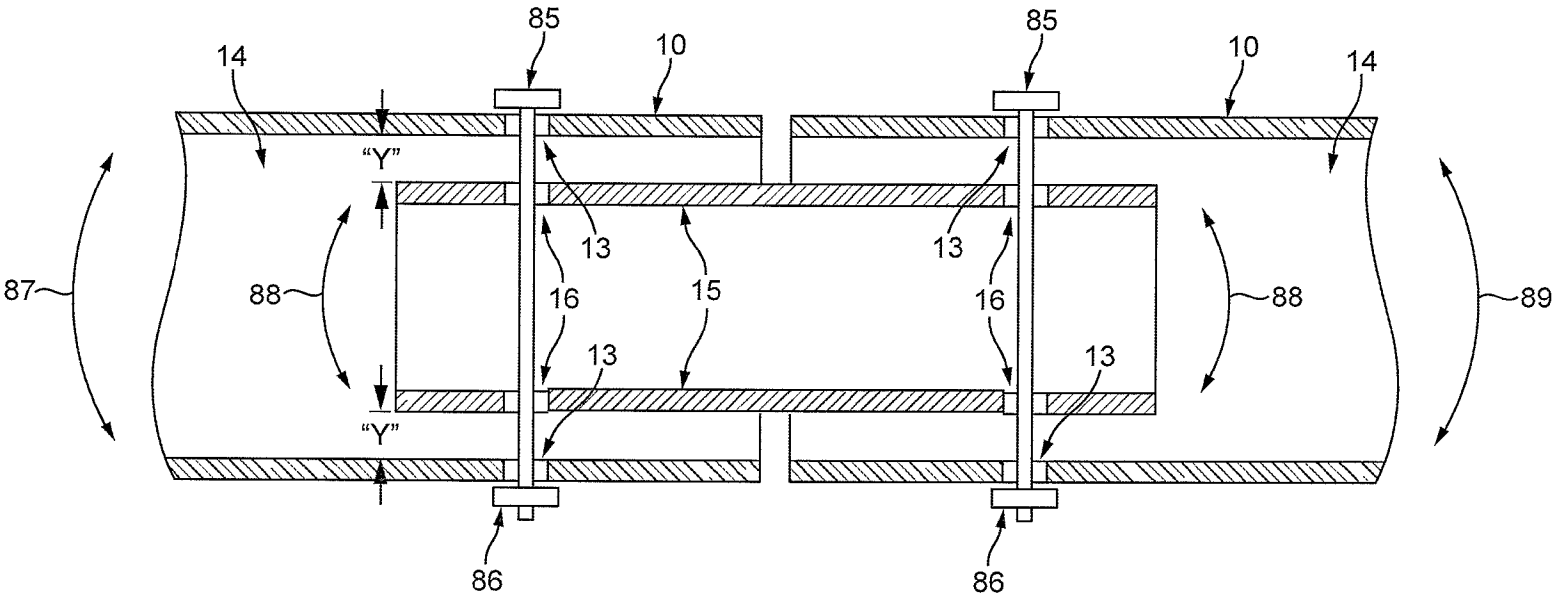
FIG. 15 schematically illustrates a part of the barrier illustrated in FIGS. 1 to 5.

A bolt, pin, rod or other suitable fastener (85; FIG. 15 and FIG. 16) passes into openings (13) formed in the steel plate of the respective box-section tube (10) forming the fore edge or rear edge of abutted support members. The fastener simultaneously extends through a link portion (16) of a coupling member (15) which has been inserted into the fore edges (or rear edge) of successive support members, so that it passes from the box-section bore of one fore/rear edge of a support member and into the box-section bore of the other fore/rear edge, where the two opposing bores meet (12). Each one of the two link portions of a coupling member is thereby coupled therethrough to a respective one of the two abutted, and consequently coupled, support members (2).

Figure 16A:
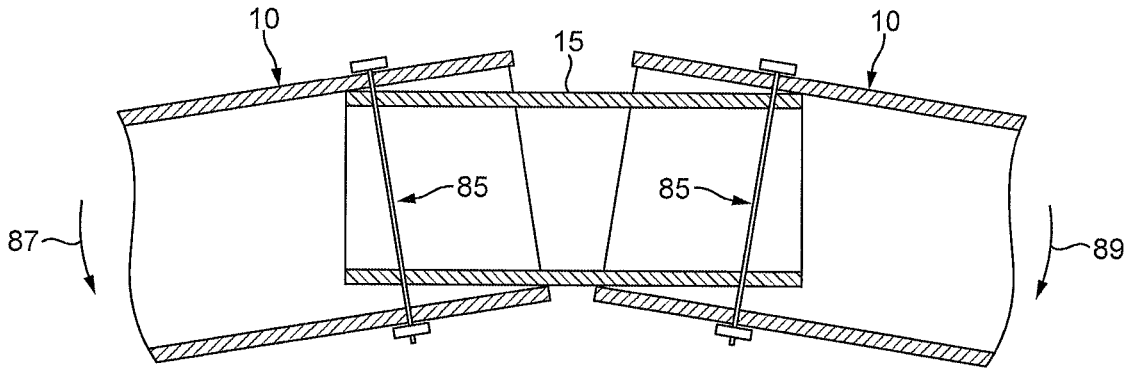
FIGS. 16A and 16B each schematically illustrates a part of the barrier illustrated in FIG. 15.
Figure 16B:
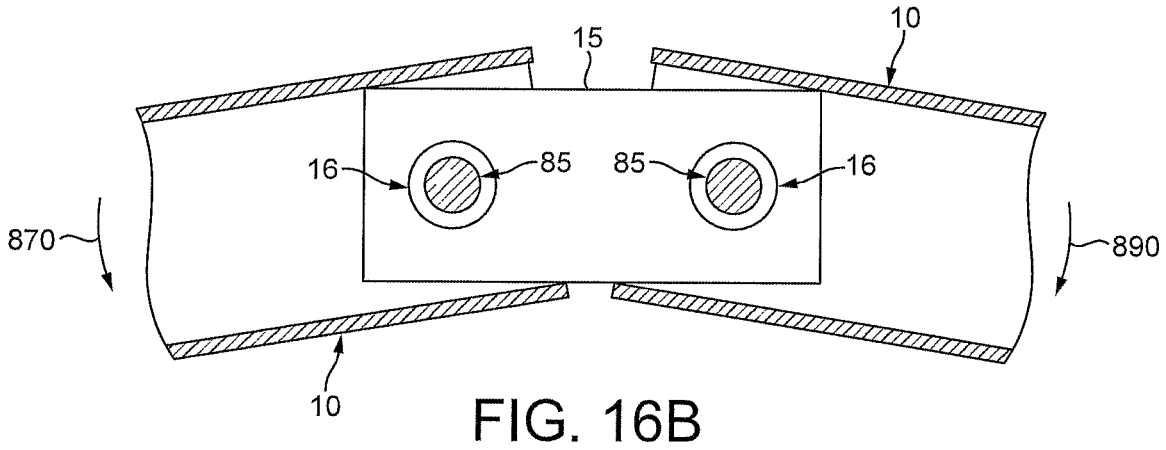

Referring to FIG. 15, and FIGS. 16A and 16B, a series of cross-sectional views are shown illustrating schematically the inter-relationship between an inserted coupling member and the parts of adjacent support members coupled by it. Part of the coupling member (15) extends in spaced opposition over an opposing inner box-section bore surface (14) of each support member (10) coupled thereby. The coupling member is pivotable about the through-openings (16) formed within it, in a direction (88) transverse to (see FIG. 16A) the opposing surface of the inner bore (14). A part of the coupling member (15) extends in spaced opposition (see spaced separation "Y") over an opposing surface of each support member coupled by it. This spacing permits such movement. The coupling member overlaps an immediately adjacent opposing area, face or part of the support members to which it is coupled, with sufficient spacing therefrom to allow a limited pivoting movement relative to the support member to bring parts of the coupling member into abutment against opposing parts of the support member to prevent further such pivoting movement. In this way, a relatively loose fit between a coupling member and a support member to which it is coupled, allows the coupling member some "wiggle room" in its connection to the support member, and therefore in the coupling between support members.

The link portions (16) are in register with opposing through-openings in opposing walls of the box-section tube (10) of respective support members, and a pivot axle (85: e.g. bolt, or pin) passes from one opposing through-opening to the other via the link portions (16). The diameter of the coupling member is less than the diameter of width of the inner bore of the tube to enable the coupling member to loosely fit inside the tube. The link portions (16) of the coupling member (15) loosely fit around the pivot axle (85). The box-section shape of the coupling member reciprocally mirrors the box-section shape of the inner bore of the beam (10) of a support member into which it is inserted, to allow a loose but sympathetic fit of the former within the latter. The ratio (d/D) of the width ('d'; i.e. lateral dimension, vertically or horizontally) of the coupling member within the diameter ('D'; equivalent lateral dimension) of the box-section bore of the support member beam (10) is about 0.95. This relative dimensioning allows good "wiggle room" between the coupling member and the support member it couples. The coupling member is also pivotable about the through-openings (16) in a direction parallel to (e.g. across: see FIG. 16B) the opposing surfaces of the inner box-section bore (14) of a respective support member.

This is schematically illustrated in FIG. 16A, showing a rotation (87, 89) of support members relative to a coupling member within the horizontal plane (e.g. across a road surface), and FIG. 16B showing a rotation (870, 890) of support members relative to a coupling member within the vertical plane (e.g. transverse to a road surface, in order to follow the camber thereof).

Figure 11A:
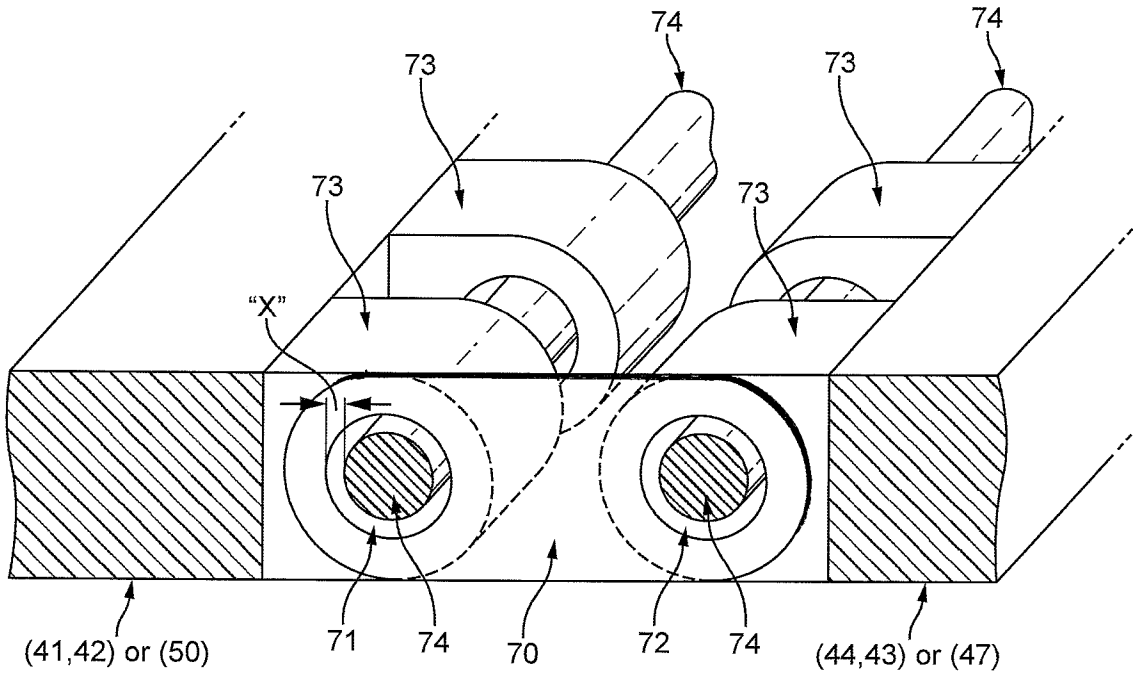
FIG. 11A schematically illustrates a cross-sectional view of coupling members interconnecting barrier elements of the barriers illustrated in FIG. 6.
Figure 11B:
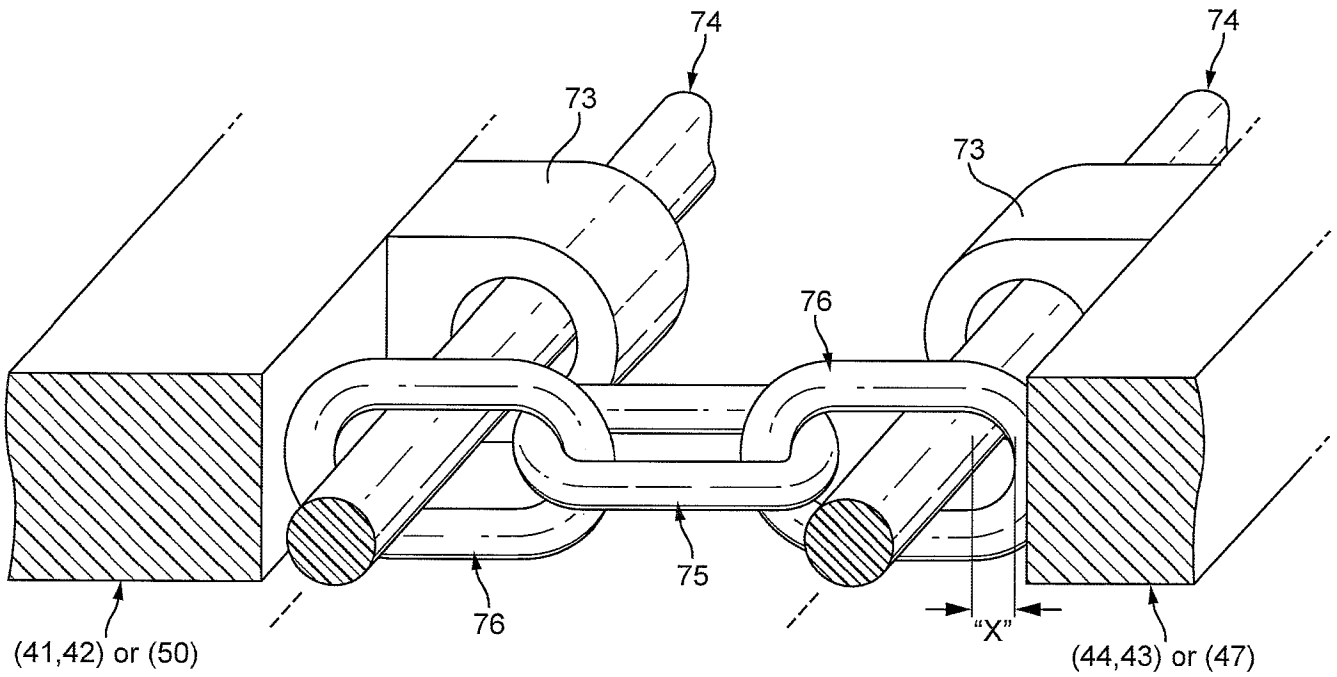
FIG. 11B schematically illustrates a cross-sectional view of coupling members interconnecting barrier elements of the barriers illustrated in FIG. 6.

In other examples, the coupling member comprises a single elongated plate (e.g. steel) containing through-openings at opposite ends, or may comprise a chain of only three links, the terminal chain links provide the link portions of the coupling member and a respective pivot member passes through each terminal chain-link. In preferred embodiments, whatever form the coupling member takes, the diameter of a pivot member is preferably less than the diameter of a link portion (e.g. through-opening, or the eye of a chain-link) of a coupling member through which it passes, such as to form a loose fit therein. The pivot member (85) is dimensioned to retain the coupling member in connection with a support member, but not to fix the spatial orientation of the coupling member relative to the support member. This allows an adjustability of the special orientation of the coupling member relative to the support member. FIG. 11A and FIG. 11B, show examples of such alternative forms of coupling member. Referring to FIG. 11A, the coupling member is entirely rigid (as is the coupling member 15 of FIG. 2). There, the coupling member comprises one or more rigid plates (15; 70) through the face of which through-holes pass (16; 71, 72) defining respective link portions. However, the coupling member is articulated in the embodiment illustrated in FIG. 11B (and associated Figures). In this latter case, the coupling member comprises three chain links in a chain of which each through-hole portion is provided by an eye in a respective one of the terminal two links in the chain, and the rigid joining portion comprises the one intermediate link in the chain (75).

The elongated barrier members (3) are pivotably connected to a respective support member to be moveable about a pivot axis located within the support member from a stowed position to a deployed position. The barrier member upon a given support member is upwardly inclined relative to the support member and the ground surface when in said deployed position, as shown in FIGS. 1 and 2. Each elongated barrier member comprises a linear box-section tube terminating in a spike outwardly presented when the barrier member is in the deployed position. The plurality of elongated barrier members are each independently pivotably connected to an associated support member to be moveable independently about a respective pivot axis located within the support member from a stowed position to a deployed position. The pivot axis is located adjacent a rearmost longitudinal edge of the support member (i.e. furthest from the direction of an oncoming/impacting vehicle, in use) such that the barrier member extends therefrom in a direction over the support member towards an opposite longitudinal edge of the support member (i.e. the edge nearest the oncoming vehicle) and terminates without extending over the opposite longitudinal edge when in the deployed position. This particular dimensioning of the barrier member ensures that an impacting vehicle has mounted the surface of the support member when it makes contact with the spiked tip of the barrier member. As a result, turning forces (torque) applies to the barrier by the impacting vehicle, via the deployed barrier member (3) is opposed by the weight of the impacting vehicle upon the support member (2). The barrier member may be shorter than the width of the support member, in preferred embodiments such as illustrated here, for this reason.

The support member comprises a recess (6) adapted receive a barrier member (3) when in the stowed position. Use of the recess is schematically illustrated in FIG. 12 which shows a barrier member in a deployed position (3A) relative to a support member, and also in a deployed position (dashed lines, 3B) in which the barrier member is entirely received within, and stowed by, the recess (6).

Figure 3:
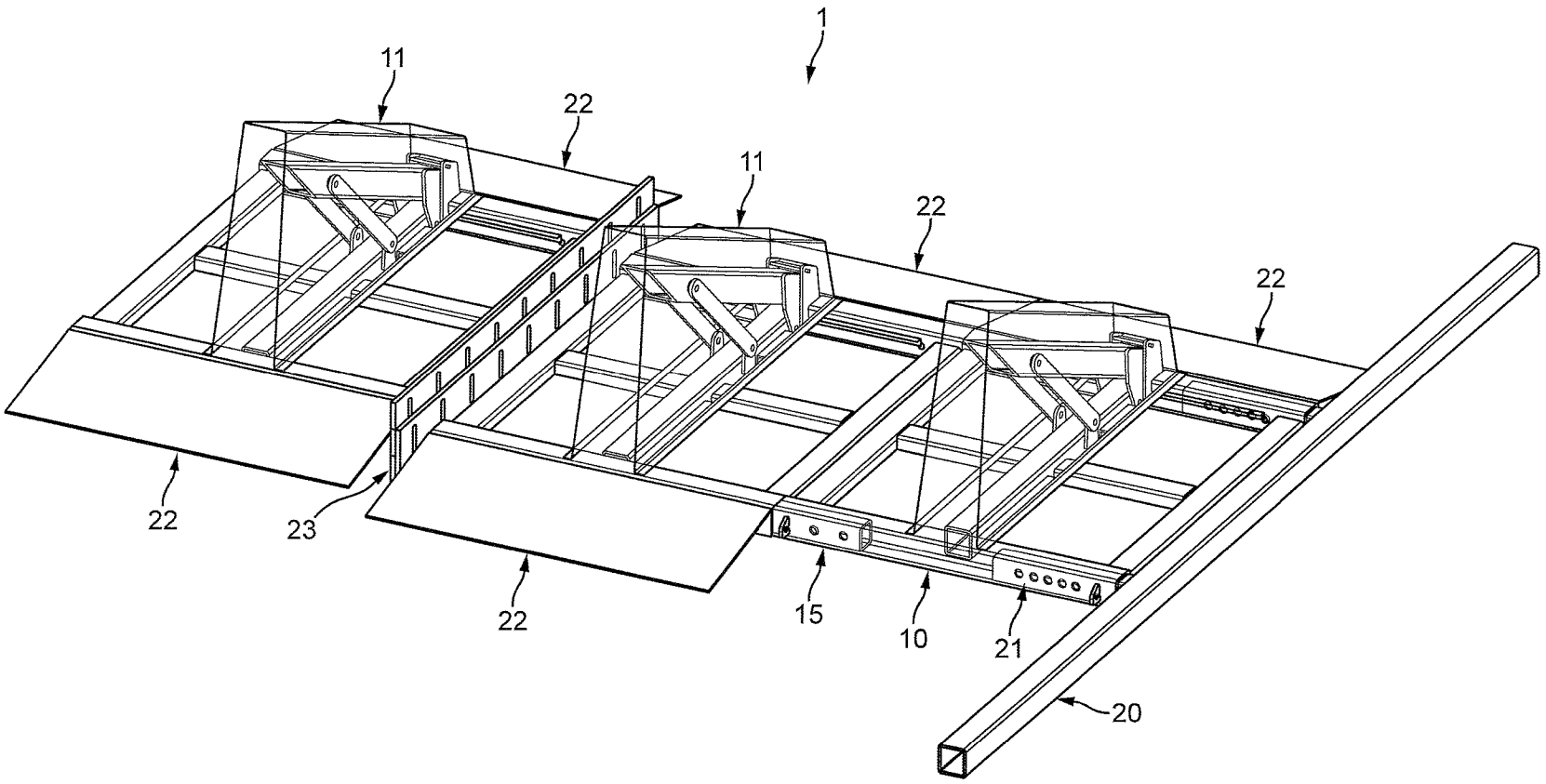
FIG. 3 illustrates a view of key components of a vehicle barrier including the vehicle barrier of FIG. 1.
Figure 12:
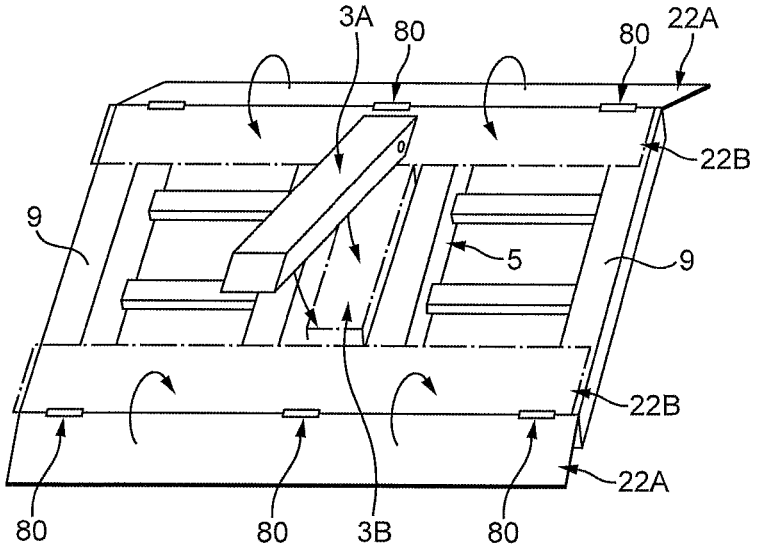
FIG. 12 schematically illustrates the deployed and stowed positioning of parts of the barrier illustrated in FIGS. 1 to 4.

The vehicle barrier apparatus also comprises two ramp members, as illustrated in FIG. 3 in a deployed state and in FIG. 12 in both a deployed state and a stowed state. Each ramp member is pivotably connected, e.g. via hinges (80), to a support member to be moveable about a pivot axis substantially parallel to a respective one of the two opposite longitudinal edges of the support member defined by the fore edge and the rear edge beams (10) thereof. The longitudinal edge of a ramp (22) is connected by hinges (80) to the outermost upper (or edge) surface of a respective longitudinal edge. Pivoting motion about these hinges allows each ramp member to be moved from a stowed position (22B) to a deployed position (22A) of ground engagement thereby to define a ramp surface extending from the ground surface to an upper surface of the support member. The upper surface of the framework forming a support member at either side of the recess (6) formed therein, may be covered by planks or sheets of rigid material to enable a pedestrians to pass over the upper surface of the support member, in the spaces between successive barrier members, as desired. The inner framework parts (9) of each support member are recessed relative to the fore edge and rear edge beams (10) to define a space into which such covering planks or sheets of rigid material may be received and abutted against opposing vertical surfaces of the fore edge and rear edge beams (10) revealed by the recess and facing each other across it. This allows secure placement of covering planks/sheets.

Figure 5:
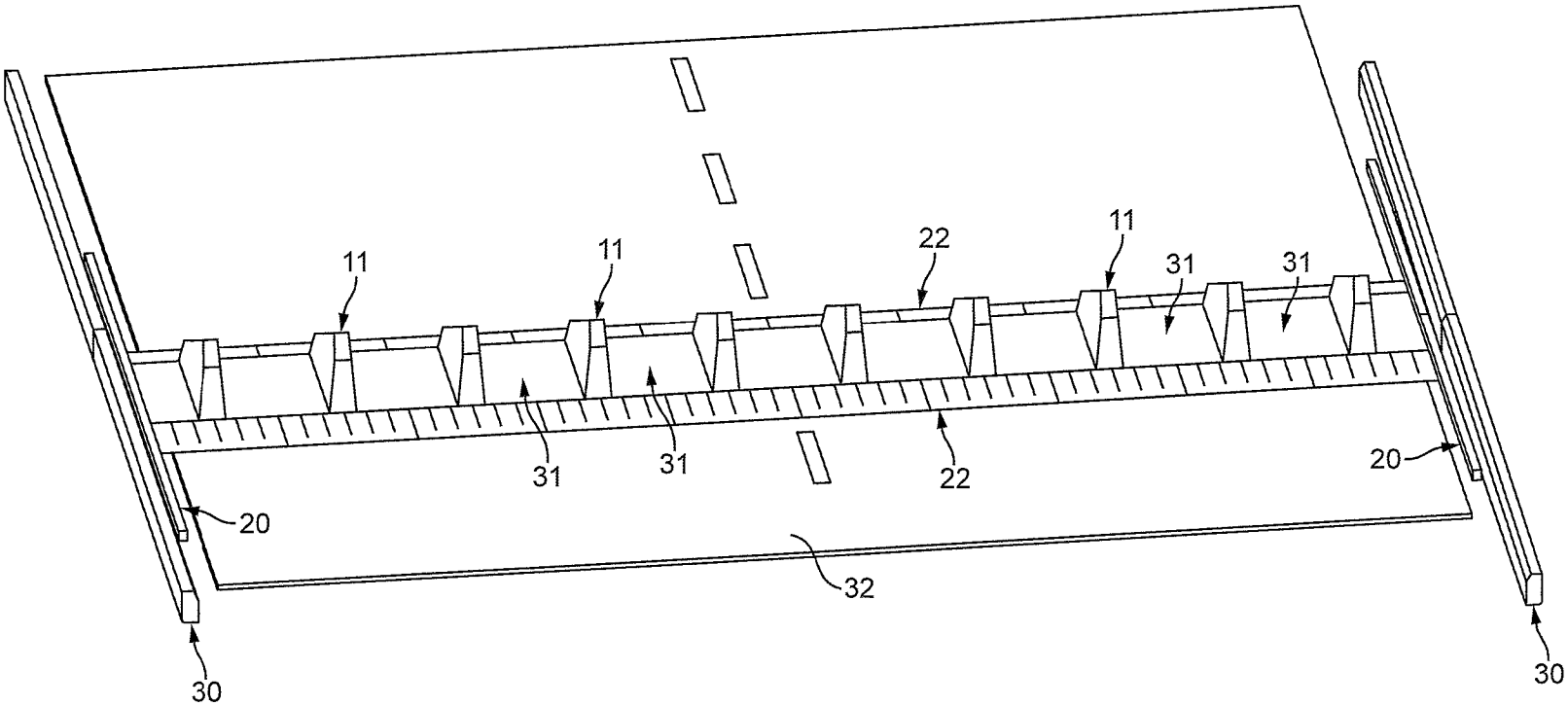
FIG. 5 illustrates a view of a complete vehicle barrier incorporating the vehicle barrier parts of FIGS. 1 to 4.
Figure 6:
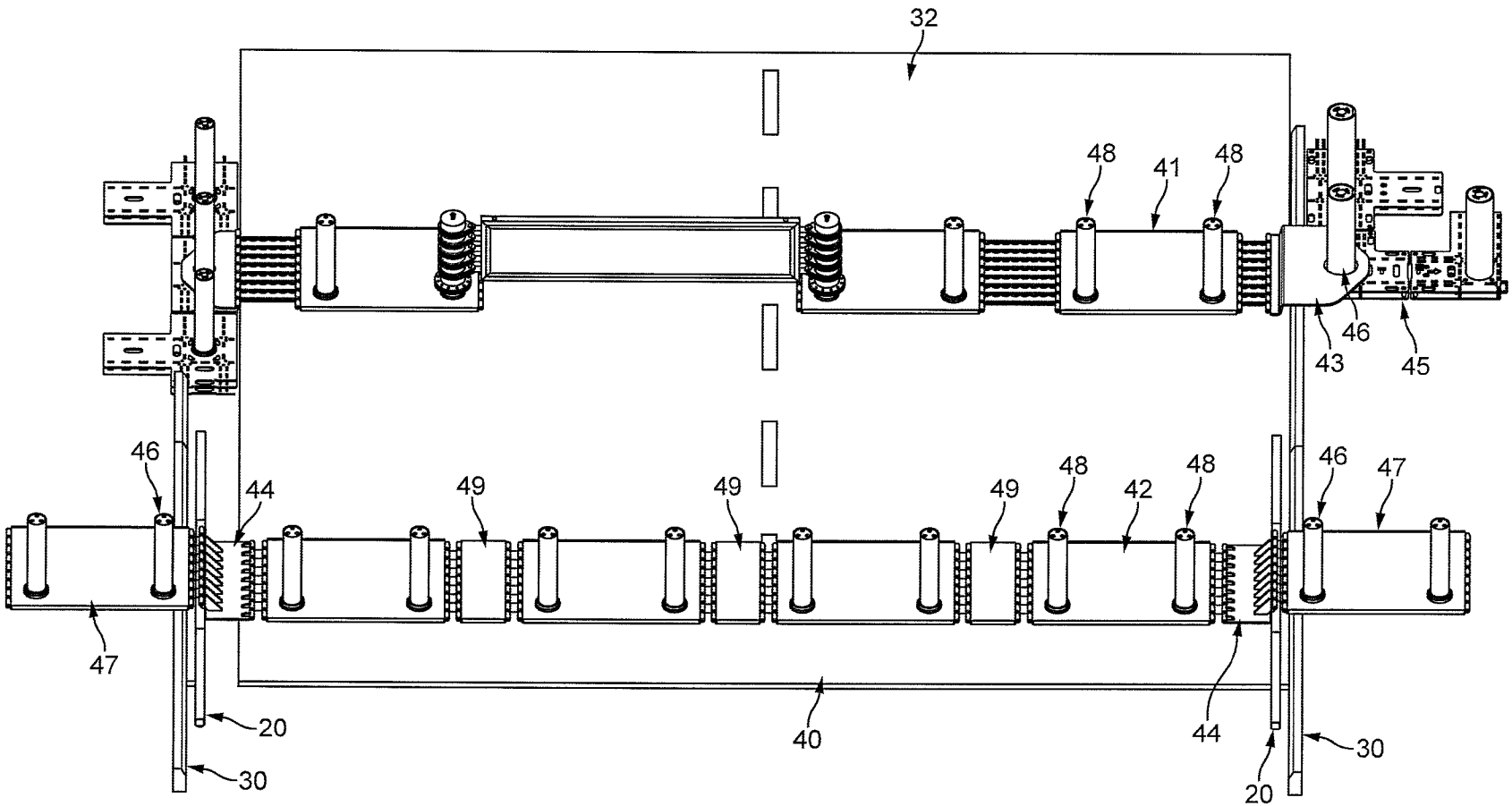
FIG. 6 shows a view of alternative vehicle barriers according to embodiments of the invention.

The vehicle barrier apparatus includes a removable cover member (11) detachably attachable to the support member and dimensioned to house the salient parts of the barrier member when in the deployed position. FIG. 1 shows an example of a cover member attached to the upper surface of a support member in use, so as to cover a barrier member within it. FIG. 2 shows an exploded view in which the cover member is raised above the surface of the support member to reveal the barrier member otherwise concealed within the inner volume of the cover member. The cover member is a sacrificial cover formed from a material, such as a brittle plastic material, or thin wood, which is friable to reveal the barrier member housed within it upon breakage by impact from a vehicle. The material is sufficiently strong to resist impact (e.g. knocks and bumps) by passing pedestrians. Suitable plastics or wood materials, such as would be readily apparent to the skilled person, may be used for this purpose. FIG. 5 shows an example of a vehicle barrier formed by a succession of coupled support members, with their associated barrier members in the deployed position, yet concealed within respective cover members (11). Ramp members (22) at opposite longitudinal edges of the vehicle barrier are in the deployed position along pedestrians to mount and dismount the vehicle barrier, via the ramps, and planks or sheets of rigid material (31) are laid upon the framework of each support member so as to extend laterally across associated support members from one ramp member to the other.

Figure 13:
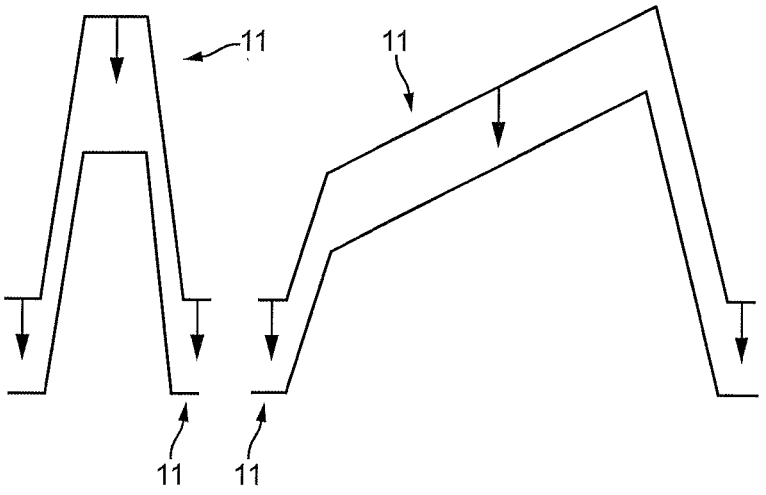
FIG. 13 schematically illustrates the deployed and stowed positioning of parts of the barrier illustrated in FIGS. 1 to 4.

The cover member is tapered such that its outwardly-presented surfaces are inclined towards a common axis. The surfaces are formed by thin sheet material such that the concave inner shape defining the inner cavity space of the cover member, reciprocates its outer convex shape permitting the cover member to fit within the reciprocally-shaped cavity space of another identical cover member for stacking. FIG. 13 shows this stacking functionality schematically.

Figure 4:
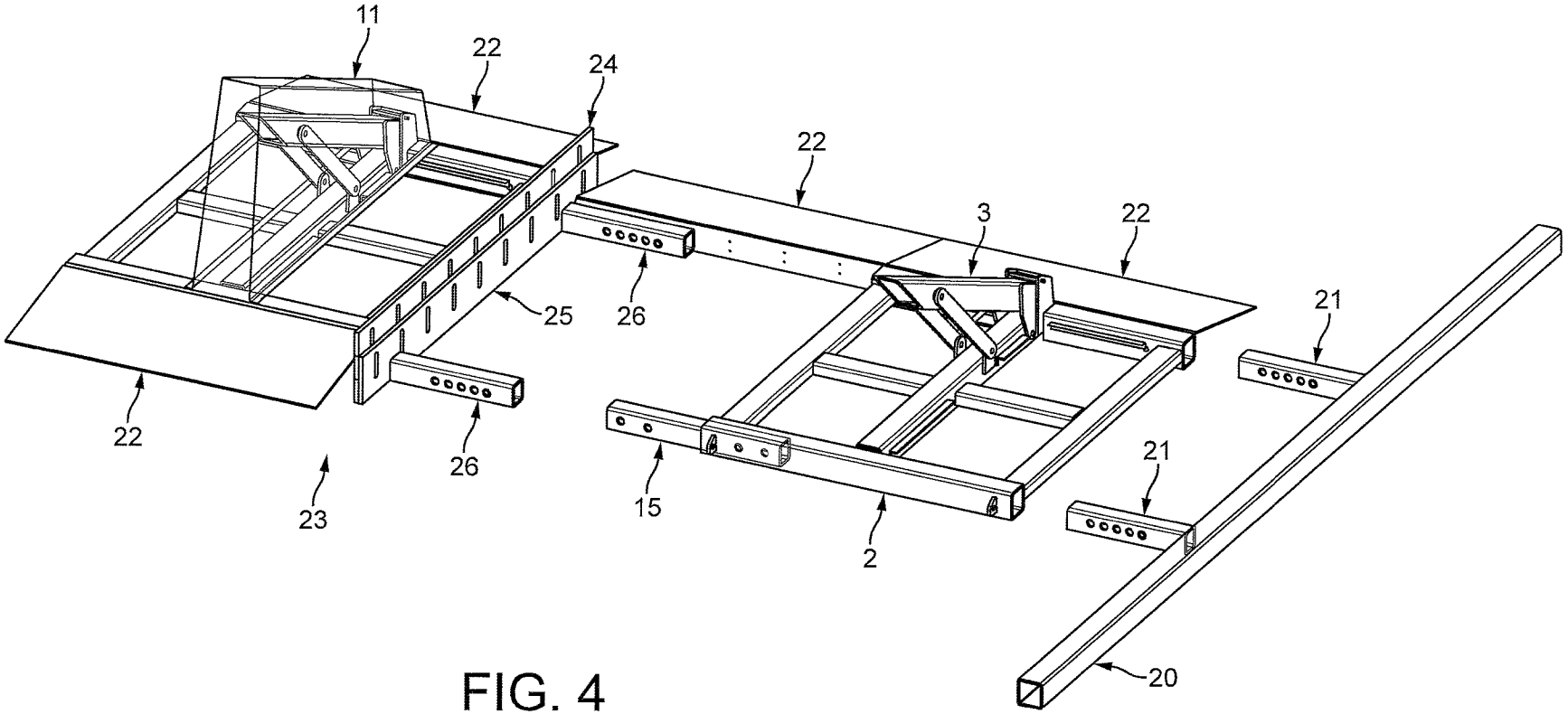
FIG. 4 illustrates an exploded view of the vehicle barrier of FIG. 3.

FIG. 3, FIG. 4 and FIG. 5 shows examples of the vehicle barrier apparatus adapted for placement adjacent to a kerb or adjacent to two opposing kerbs therebetween. The apparatus includes a plurality of barrier members (see FIG. 5) such as those described above, and FIGS. 3 and four show partial or exploded views of component parts of the barrier to better aid illustration of the arrangement. The barrier comprises support members (2) such as described above with reference to FIG. 1, being adapted for ground engagement by placement upon a ground or floor surface. Each support member includes an aforesaid barrier member (3). In addition the two terminal support members disposed at opposite terminal ends of the vehicle barrier also include a respective kerb-abutment member (20) connected thereto and extending laterally therefrom for placement alongside a kerb (30) adjacent to a part of the ground or floor surface (32) other than that over which the support members of the vehicle barrier extend. The kerb-abutment member (20) is placed alongside a kerb (30) close to the side of, or next to, the kerb. It is thereby in cooperation with the kerb. This applies at opposite terminal ends of the vehicle barrier in respect of opposing curbs at opposite sides of the road (32). When impacted by a vehicle, the vehicle barrier absorbs impact forces by transmitting them laterally along the length of the barrier. However, those impact forces include turning forces which tend to cause individual support members to move to cause the vehicle barrier to deform into a curved shape. The kerb abutment members (20) coupled to the terminal support members of the vehicle barrier prevent those terminal support members from rotating of the road surface and allow a resistive counter-torque, or reactive force to be generated from an opposing kerb surface against which they abut.

Each kerb-abutment member extends laterally in opposite directions from the associated terminal support member (2) for placement alongside a kerb extending at opposite sides of the support member. That is to say, the kerb-abutment member extends both in front of, and behind the vehicle barrier in the direction towards an oncoming vehicle, and in the direction away from an oncoming vehicle. Depending on the direction in which impact causes the vehicle barrier to be urged to rotate, a forward-extending kerb-abutment member will be urged against an adjacent kerb, and simultaneously a rearward-extending kerb-abutment member at the opposite end of the vehicle barrier will be urged against its adjacent kerb. In this way, by providing both forward-extending and rearward-extending kerb-abutment members at each terminal end of the vehicle barrier, each end of the barrier may assist in stiffening the line of support members in the face of oncoming vehicle impact. Alternatively, rearward-extending kerb-abutment members alone may be used. A strut, or struts, (not shown) may connect (e.g. diagonally) a support member and a kerb-abutment member. The strut(s) may extend from a rear side of a support member, opposite to the side (e.g. front) of the vehicle barrier intended/arranged to receive vehicular impact, to connect with a kerb-abutment member at a location thereupon at the rear of the vehicle barrier. Thus, rearward-extending kerb-abutment members may be braced against the rear part of a support member.

The kerb-abutment member (20) is detachably attachable to the support member. It comprises a pair of linear box-section tubes of rigid material (steel) dimensioned to be removably insertable into the reciprocally-shaped bore of the fore-edge and rear-edge longitudinal beams (10) of a terminal support member (2) of the vehicle barrier. This space-apart pair of parallel, linear coupling arms (21) extend from a common side of the kerb-abutment member. The spacing between the coupling arms much as the spacing between the fore-edge and rear-edge longitudinal beams (10) of a terminal support member, and the diameter, width or equivalent lateral dimensions of each coupling on is such as to permit a respective coupling arm be inserted into the fore-edge and rear-edge longitudinal beams simultaneously and in unison.

The through-openings (13) provided in the longitudinal beams for receiving fastening bolts, or pins, of coupling members (15) described above with reference to FIGS. 1, 2, 16A and 16B, are also able to accept such fastening bolts or pins to pass through cooperating through-openings in each inserted connecting arm (21) of a kerb-abutment member to permit secure connection of a kerb-abutment member to both the fore-edge and rear-edge longitudinal beams (10) of a terminal support member (2) of the vehicle barrier.

FIG. 3, FIG. 4, FIG. 9, FIG. 10 and FIG. 14 each show successively more detailed views of a vehicle barrier apparatus for placement across a kerb. The apparatus comprises at least two barrier members and at least two associated support members adapted for ground engagement by placement upon a ground or floor surface. The barrier members and support members may be substantially as described above. An intermediate member (23) is coupled to, and between, each of two of support members (2A, 2B) across a kerb from a lower ground or floor surface (e.g. a road surface) upon which one (2B) of the two support member is placed to a higher said ground or floor surface (e.g. a pavement) upon which the other one (2A) of the two support members is placed. In particular, the intermediate member comprises a first sliding interface member (25) connected to the support member (2A) placed upon the upper ground surface, and in adjustably sliding abutment against a second sliding interface member (24) connected to the support member (2B) placed upon the lower ground surface. Each sliding interface member comprises a rectangular plate with a uniform width disposed in an upright position, substantially in the vertical plane, and extending beyond (i.e. proud of) the surface of the support member to which it is attached. In particular, the first sliding interface member (25) extends vertically upwards beyond the uppermost surface of the support member (2B) placed on the lower ground surface, whereas the second sliding interface member (24) extends vertically downwards beyond the lowermost surface of the support member (2A) placed on the upper ground surface. The second sliding interface member extends a greater vertical distance than does the first sliding interface member, and also extends vertically upwards beyond the uppermost surface of the support member (2A) placed on the upper ground surface.

An array of parallel, evenly-spaced vertical through-slots (250) extend through the abutment surface of each one of the first sliding interface member and the second sliding interface member such that at least a part of each slot of the first sliding interface member is in register with at least a part of a respective one of each of the slots of the second sliding interface member.

Figure 14:
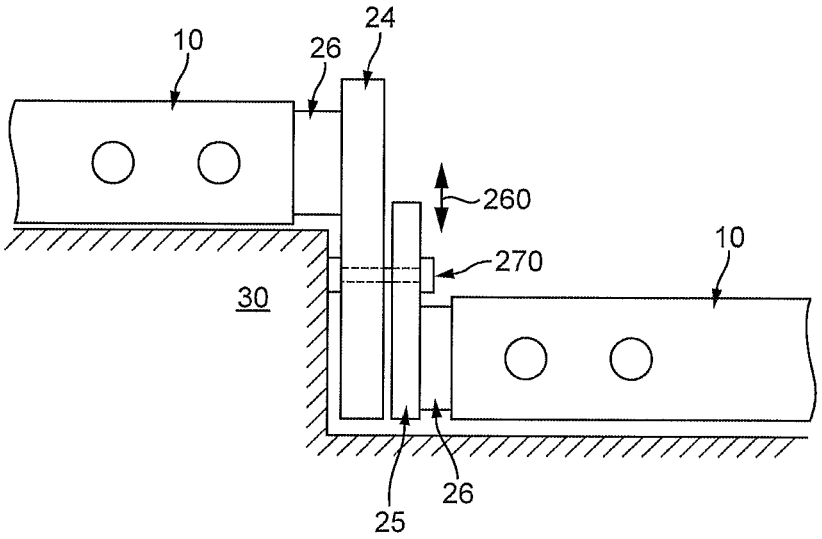
FIG. 14 schematically illustrates a part of the barrier illustrated in FIGS. 3 and 4.

The second sliding interface member (24) is vertically wider than the first sliding interface member, and its vertical slots are each a longer than those of the first sliding interface member (25). One or more fastening members (270: FIG. 14), such as a bolt fastened by a nut, passes from the first sliding interface member to the second sliding interface member entirely through corresponding in-register slots formed therein, and is tightened to securely fasten the opposing first and second sliding interface members together. The vertical extent of the co-registered slots (250) permits a vertical adjustment in the position of the upper support member (2A) relative to the lower support member (2B) according to the height of a kerb (30) across which the vehicle barrier extends.

In length, each sliding interface member extends along the entire width of a support member to which it is attached, from the fore-edge thereof to the rear-edge of the support member. In this way, each sliding interface member outwardly presents an abutment surface adapted to be abutted against the opposing abutment surface presented by an opposing sliding interface member.

Each sliding interface member (24, 25) is detachably attachable to the support member serves. Each comprises a pair of attachment arms comprising a linear box-section tube of rigid material (steel) dimensioned to be removably insertable into the reciprocally-shaped bore of the fore-edge and rear-edge longitudinal beams (10) of a terminal support member (2) of the vehicle barrier. This space-apart pair of parallel, linear coupling arms (21) extend from a common side of the respective sliding interface member. The spacing between the coupling arms much as the spacing between the fore-edge and rear-edge longitudinal beams (10) of a support member in question, and the diameter, width or equivalent lateral dimensions of each coupling on is such as to permit a respective coupling arm be inserted into the fore-edge and rear-edge longitudinal beams simultaneously and in unison.

The through-openings (13) provided in the longitudinal beams for receiving fastening bolts, or pins, of coupling members (15) described above with reference to FIGS. 1, 2, 16A and 16B, are also able to accept such fastening bolts or pins to pass through cooperating through-openings in each inserted connecting arm (21) of a sliding interface member to permit secure connection of a sliding interface member to both the fore-edge and rear-edge longitudinal beams (10) of a terminal support member (2) of the vehicle barrier.

Figure 7:
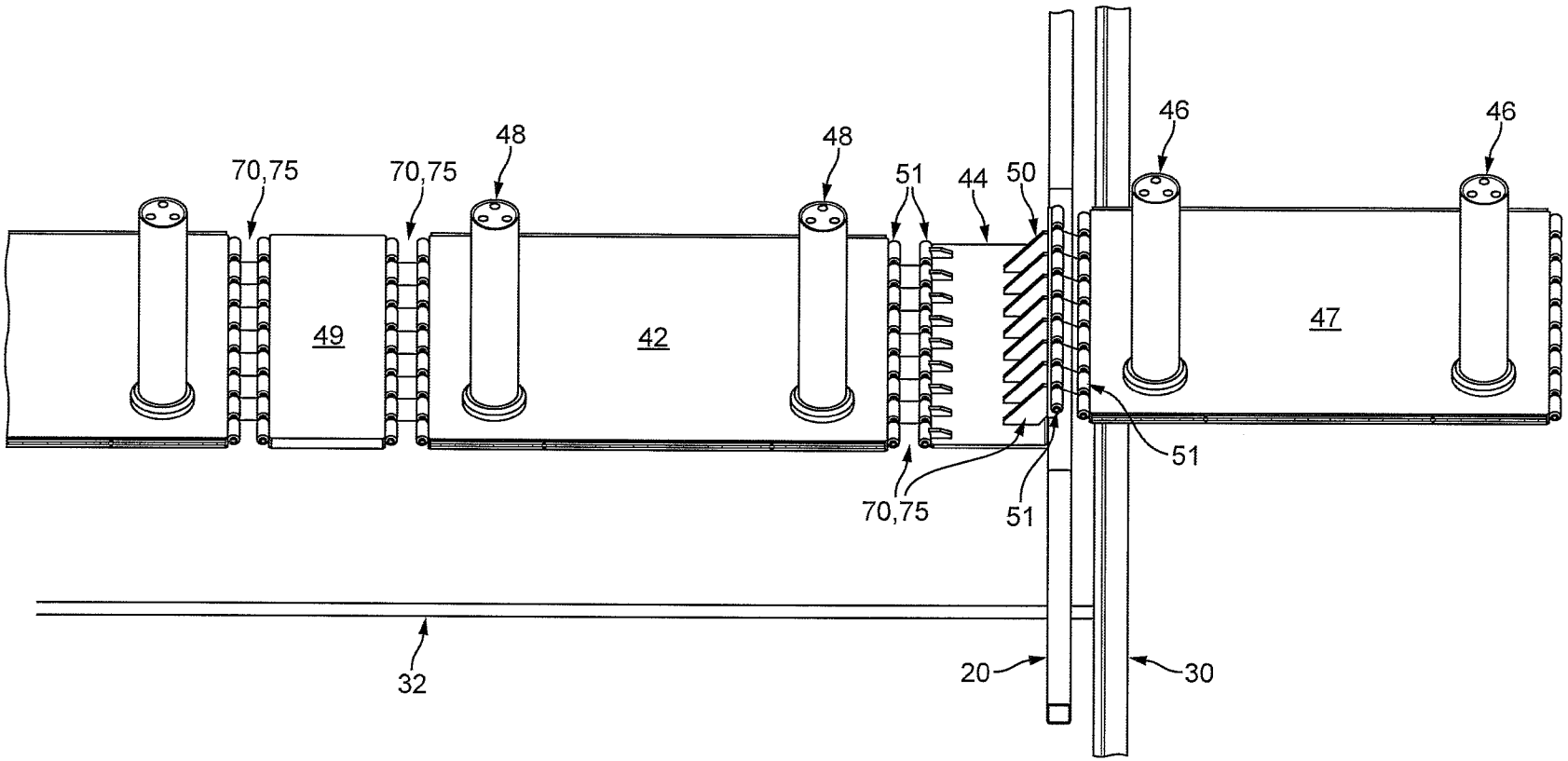
FIG. 7 shows a magnified view of a portion of a vehicle barrier illustrated in FIG. 6.

FIG. 6, FIG. 7, FIG. 8 and FIGS. 11A and 11B illustrate further examples of embodiments of a vehicle barrier according to aspects of the invention. FIGS. 7 and eight show close-up views of the kerb-crossing ends of the barriers shown in FIG. 6.

These Figures illustrate examples of a vehicle barrier apparatus for placement across a kerb. The apparatus comprises one or more barrier members (46, 48) and two or more support members (41, 42, 45, 47) adapted for ground engagement by placement upon a ground or floor surface. Each support member includes at least one barrier member. An intermediate member (43, 44) is coupled between each of two of such support members cross a kerb (30) from a lower ground or floor surface (32: e.g. a road surface) upon which one of said two support member is placed, to a higher said ground or floor surface (e.g. a pavement) upon which the other one of the two support members is placed. The intermediate member (43, 44) is coupled to one or both of the two support members by at least one coupling member (70, 75, 750) passing from at least one support member to the intermediate member thereby to couple the respective support member to the intermediate member such that vehicular impact forces inducing movement in one coupled support member are transmissible to the other of the two coupled support member via the intermediate member.

The intermediate member comprises a step-up structure (50) or stepped surface (60) for placement upon the lower ground or floor surface and to extend up to the higher ground or floor surface above, or over, the kerb (30). In one example such as shown in FIG. 7, a step-up structure (50) places connector elements (51, 73) of the intermediate member in raised separation from a support member (44) of the intermediate member adapted for ground engagement. These connector elements are arranged to form a connection with coupling members (70, 75) which pass from these connector elements of the step-up structure to corresponding connector elements (51, 73) arrayed along a facing edge of a support member (47) which, in turn, are arranged to form a simultaneous connection with the same coupling members (70, 75) thereby to couple the intermediate member (44) at the lower ground surface to the support member (47) at the ground surface, by the step-up structure.

Figure 8:
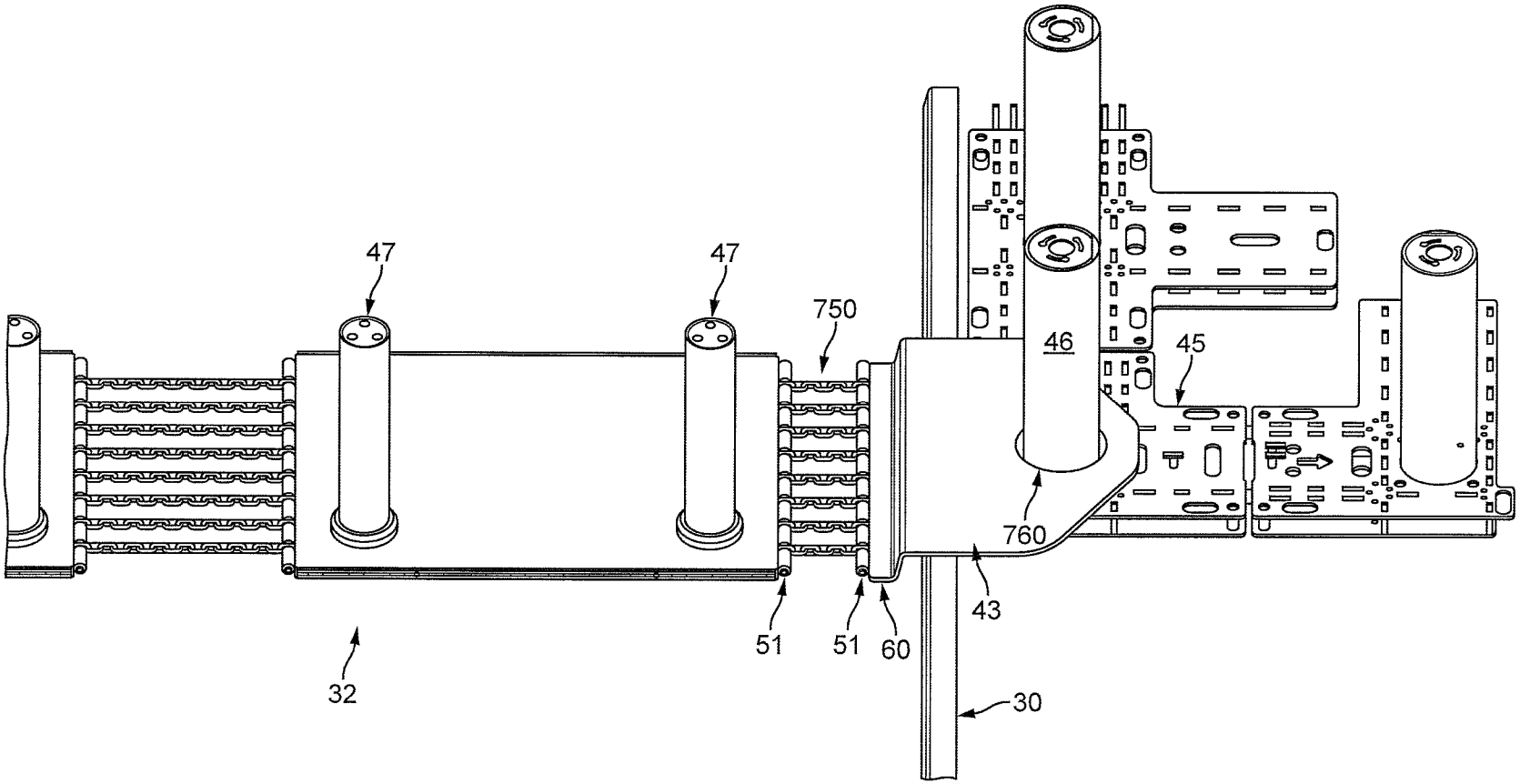
FIG. 8 shows a magnified view of a portion of a vehicle barrier illustrated in FIG. 6.
Figure 9:
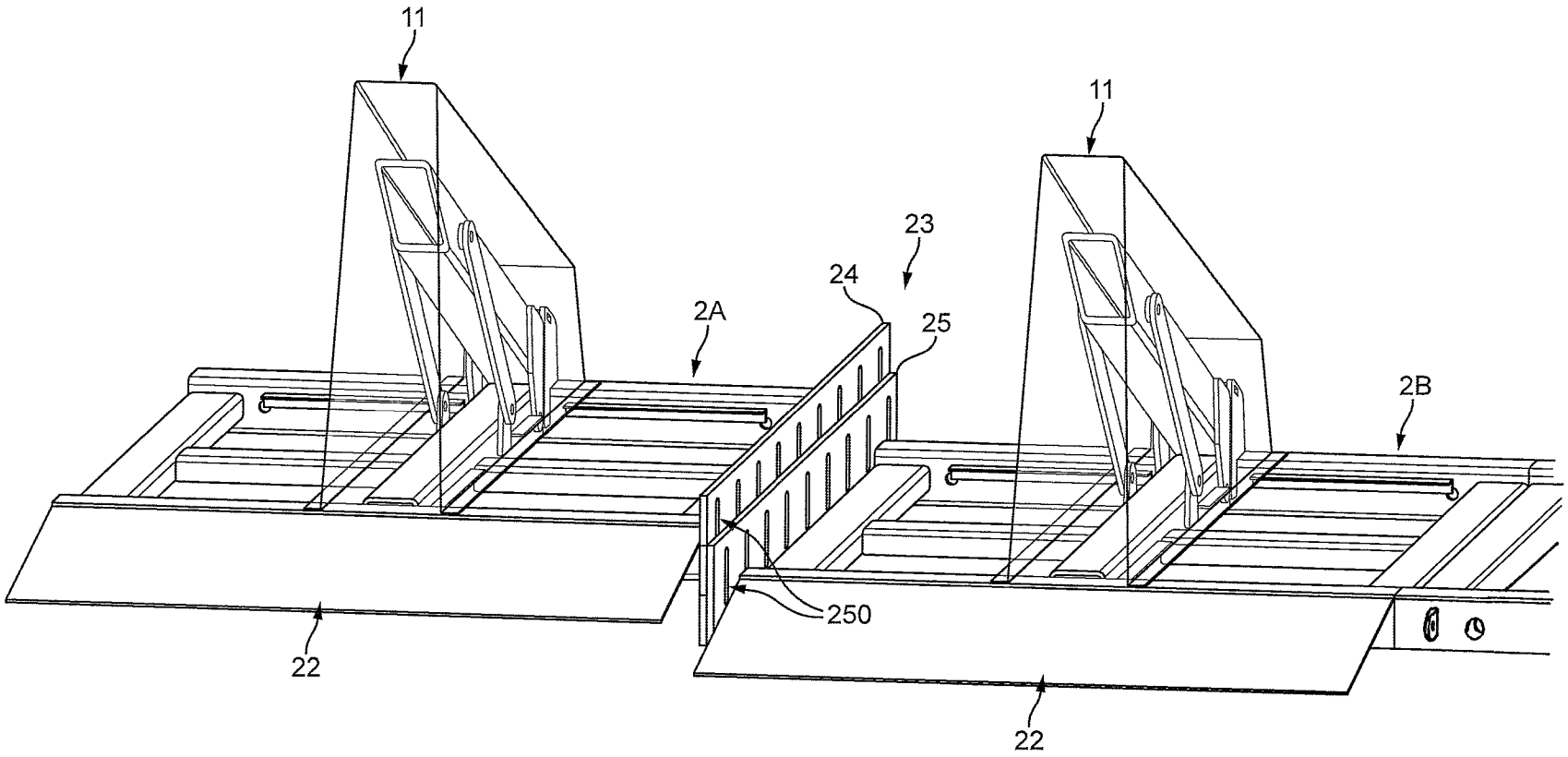
FIG. 9 illustrates a view of a barrier incorporating vehicle barrier parts of FIGS. 1 to 4.
Figure 10:
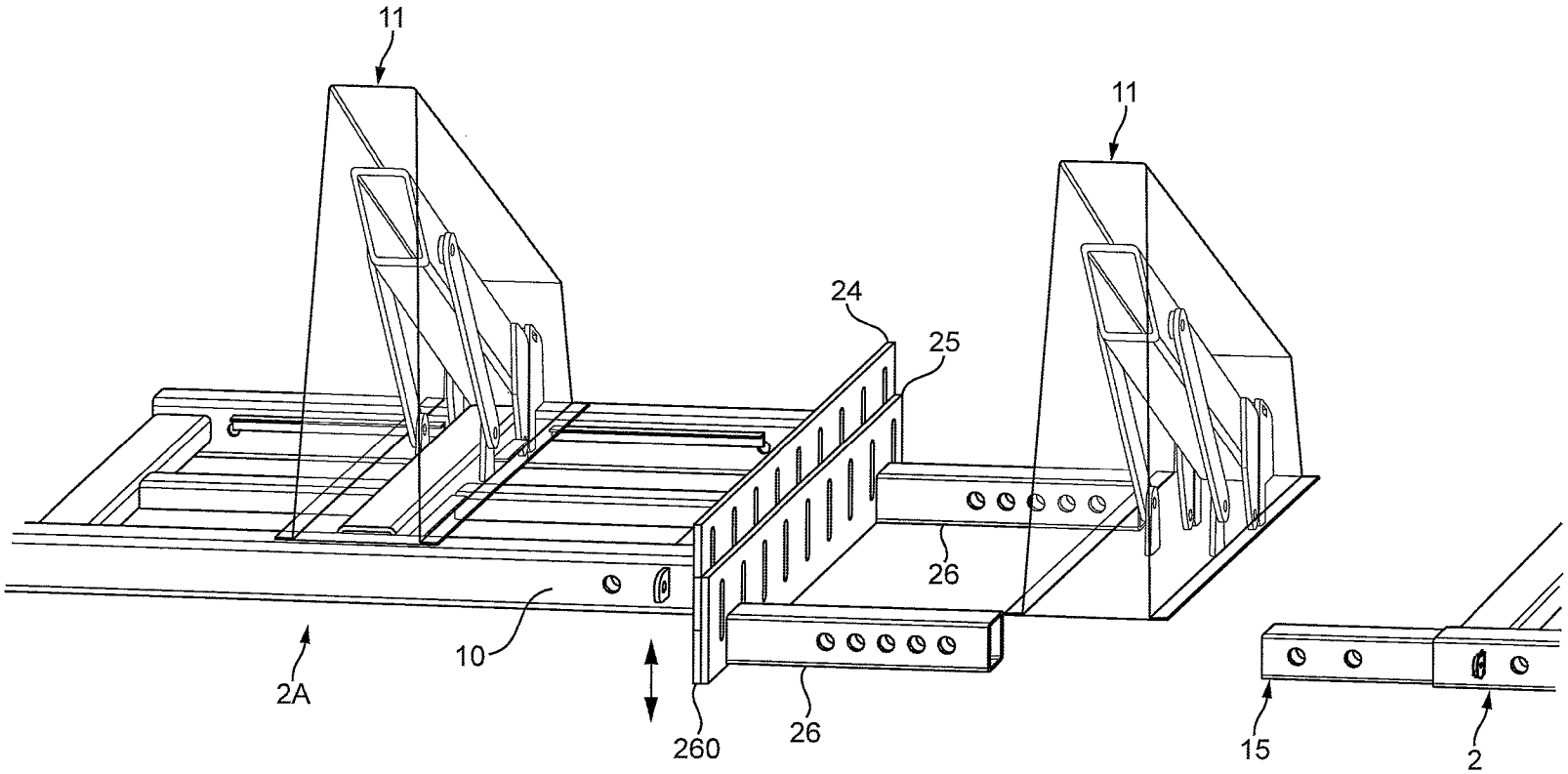
FIG. 10 illustrates the view of the vehicle barrier shown in FIG. 9, with components removed to assist clarity.

In another example, as illustrated in FIG. 8, the intermediate member may comprise a stepped surface (60) for placement upon the lower ground or floor surface and simultaneously upon an upper surface of the other of the two support members, disposed at the higher ground surface, such that the intermediate member passes across the kerb (30). In a reverse arrangement (not shown), the intermediate member may be arranged for placement upon the upper ground or floor surface (e.g. a pavement) and simultaneously upon an upper surface of one of the two support members disposed at the lower ground surface, with the intermediate member passing across the kerb between them. The intermediate member, in these examples, includes a through-opening (760) in the surface thereof for receiving a barrier member (46) extending therethrough from one of the two support members (45), to couple the intermediate member to the support member (45) comprising the barrier member (46) in question.

In either of these examples, the coupling members (70, 75) may be as described above with reference to FIG. 11A or FIG. 11B. In particular, each coupling member may comprise two separated link portions (FIG. 11A: 71, 72; FIG. 11B: 76) joined by a rigid joining portion therebetween (FIG. 11A: 70; FIG. 11B: 75). In this way, link portions are provided by fixed or articulated through-openings (this term is taken to include the eye of a chain-link). Each one of the two link portions is coupled therethrough to the intermediate member (43, 44) and to a respective one of the two coupled support members (41, 42, 47). Alternatively, as shown in FIG. 8, coupling members which couple and intermediate member (43) to a support member (41) may comprise a length of chain (750) consisting of more than only three chain links FIGS. 11A and 11B show, in schematic cross-sectional detail, an arrangement by which coupling members are connected to support members (41, 42) and/or intermediate members (43, 44) via connector elements (73; 51) arranged to form a connection with coupling members (70, 75). These connector elements comprise a connector shaft (74) threaded through a linear succession of space-report through-openings arrayed in register along a facing edge of a support member (47) or intermediate member (43, 44). The spacings between successive such through-openings admit a through-opening in a coupling member through which the connector shaft passes to form a simultaneous connection with the multiple such coupling members (70, 75) simultaneously. This connects multiple couple members along the facing edge of the support member (or intermediate member). A similar arrangement is presented on an opposing edge of a support member or intermediate member in the vehicle barrier, permitting multiple coupling members to be connected to each of two opposing edges of a support member and/or intermediate members (41, 42, 43, 44, 47, 50) to permit those coupling members and intermediate members to be coupled together.

In preferred arrangements, such as is illustrated in FIG. 11A and FIG. 11B, the diameter or lateral dimensions of a through-opening in a coupling member sufficiently exceeds the corresponding diameter or lateral dimension of the connector shaft (74) to provide a free space "X" between the two so that the coupling member is retained by the connector shaft, but is not rigidly fixed to it. This permits a certain amount of "wiggle room" between coupling members and the connector shaft which has been found to greatly assist in optimising the positioning of support members and intermediate members of the vehicle barrier across uneven surfaces.

In this way, the coupling members (70, 75) are pivotably connected to opposing terminal edges of successive support members and/or intermediate members (or spacer members) so as to be pivotable about an axis substantially parallel to a respective terminal edge. The length of a coupling member, or each coupling member of a plurality of members, may preferably be not greater than: about 25%; or more preferably about 20%; yet more preferably about 15% of the length of either one of the two terminal edges it couples together. It has been found that this relatively close proximity of opposing terminal edges of coupled support members, as enforced by appropriately length coupling members described above, has the effect of placing a limit on the angle through which one support member may rotate/slide, when impacted by a vehicle, before the rotated terminal edge is caused to impact against an opposing terminal edge of the adjacent support member to which it is coupled. This reduces the extent to which the line of the barrier comprising a plurality of coupled support members, can bend in response to an impacting vehicle and therefore increases the rate at which impact forces are transferred laterally along the barrier from one support member to other (e.g. all other) support members. The more support members can be involved in absorbing impact forces, and the quicker that they can become involved in that process during impact, the more effective the barrier has been found to be in use.

One or more of the support members may comprise no barrier member. Such a support member may serve as a spacer support member placed intermediate between two other support members and coupled to each. Such coupling may be as described above. The terminal edge by which the one or more coupling members couple the spacer support member to an adjacent support member is preferably the same length as the length of the opposing terminal edge of the adjacent support member. The length of a spacer support member, being the distance between opposite terminal edges of the spacer support member e.g. in a direction perpendicular to those terminal edges, may be less than the length of one of, or each of the support members in between which the spacer support member is coupled. The spacer support member provides a means of adjusting the length of the barrier and the spacing between barrier members. The properties of a spacer support member may be substantially as described above with respect to any other support member comprising a barrier member. This includes the interrelationship between the support member and the coupling member(s) by which the spacer support member is coupled to adjacent support members.

Figure 17:
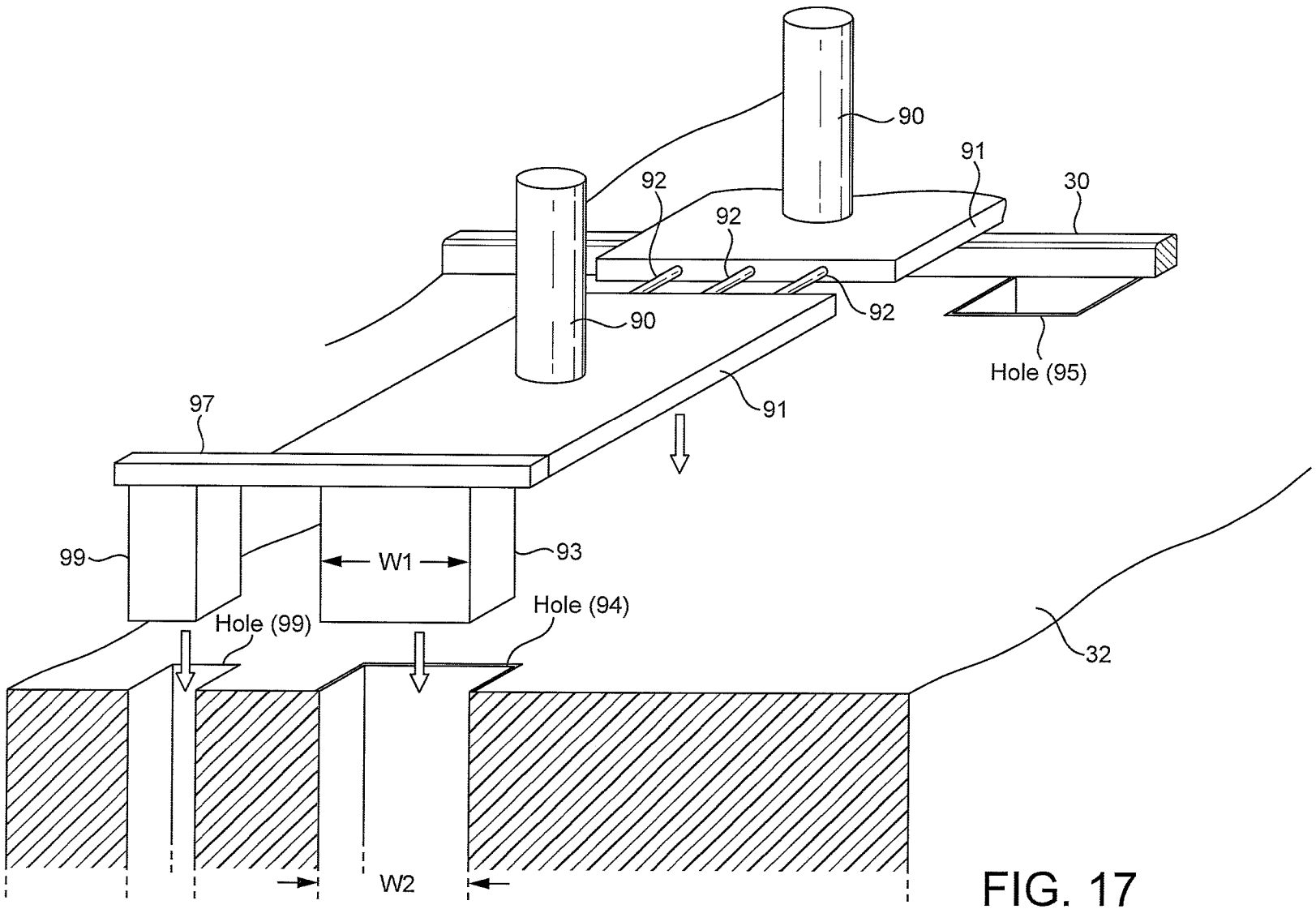
FIG. 17 schematically illustrates a vehicle barrier according to another embodiment of the invention.

FIG. 17 schematically illustrates a vehicle barrier apparatus comprising one (or more, in other examples) barrier members (90) in the form of cylindrical ballards, each extending from a respective support members (91) adapted for ground engagement by placement upon a ground or floor surface. Though shown schematically in FIG. 17, it is to be understood that a barrier member (90) may be of any alternative form such as would be readily apparent to the skilled person, and such as is illustrated and described in any other embodiment described herein. Similarly, it is to be understood that a support member (91) may be of any alternative form such as would be readily apparent to the skilled person, and such as is illustrated and described in any other embodiment described herein.

At least one of the support members (91), in particular the terminal support member of the barrier, includes a ground-insertion insert member (93) extending transversely from a ground-engagement side of the support member. This insert member is adapted for insertion into a pre-formed opening (94) within the ground or floor surface over which the barrier is arranged to extend, when in a ground-engaging position. The pre-formed opening may be, for example, a drainage hole formed in a road surface or pavement surface, or maybe a manhole, or other pre-formed whole provided for any other purpose, such as access to utilities, or the like. Alternatively, the ground-insertion member may be attached to the/a support member via a flexible line (not shown) such as a chain, cable, wire, cord, rope or strap etc.

The ground-insertion member is rectangular in shape, and is shaped to reciprocate the shape of the pre-formed opening at least in the dimension (e.g. width "W2") transverse to the long axis of the vehicle barrier (e.g. in the direction of expected vehicle travel). Accordingly, the width "W1" of the ground-insertion member may be dimensioned to closely match that of the pre-formed opening, such that it abuts opposing sides of the pre-formed opening internally when inserted therein. The ground-insertion member may be formed with barbs or serrations (not shown) along one or more edges thereof (e.g. two opposite edged) for engagement with/against side walls or aperture/hole edges of the pre-formed opening (94) for assisting in forming a 'grip' or 'catching against' the pre-formed opening e.g. when pulled.

A second ground-insertion member maybe provided at another support member (91) of the vehicle barrier for simultaneous insertion into another pre-formed opening (95), such as another drainage hole, manhole or utilities access hole located, for example, at the opposite side of the same road across which the vehicle barrier extends.

Coupling members (92), such as chains, tables or any other coupling member such as has been described herein with reference to any of the embodiments, couple opposing terminal edges of successive adjacent support members (91) to form a coupled succession of such support members, with upstanding bollards (90). When impacted by a vehicle, impact forces are transmitted from an impacting bollard (90), and into the support member connected to it, and thence to adjacent support members, via the coupling members (92) and into the ground via the ground-insertion members (93) extending from the underside of terminal support members into pre-formed holes (94, 95).

The terminal support member (91) of the vehicle barrier comprises a kerb-abutment member (97) of the type described above, which extends laterally along and away from the terminal edge of the terminal support member. Along this outwardly-projecting part of the kerb-abutment member, a ground-insertion member (98) is fixed and extends downwardly from a ground-facing side of the kerb-abutment member for insertion into a pre-formed opening (99) within the ground or floor surface (32) when the kerb-abutment member extends alongside a kerb (not shown, for clarity). The ground-insertion member extends from a part of the kerb-abutment member which is not also alongside the support member (91) and so extends from a part of the kerb-abutment member which is spaced away from the support member, into a pre-formed hole in parts of the ground surface to the rear or fore-area of the vehicle barrier.

The examples described above aim to provide illustrative examples of the invention to aid understanding and are not intended to be limiting. Thus, modifications, variations and equivalents to the examples shown here, or component parts thereof, such as would be readily apparent to the skilled person, are intended to be encompassed by the scope of the invention, such as is defined by the claims, for example.

The invention claimed is:

1. A vehicle barrier apparatus for receiving an impact from an oncoming vehicle and for placement adjacent to a kerb or adjacent to two opposing kerbs therebetween, comprising:

one or more barrier members;

one or more support members adapted for ground engagement by placement upon a ground or floor surface, and at least one of which includes at least one said barrier member;

a kerb-abutment member connected to at least one support member and for placement alongside a kerb adjacent to a part of said ground or floor surface other than that over which the at least one support member extends in placement thereupon, the kerb-abutment member for placement extending parallel to the kerb and laterally rearward of the one or more barrier members and one or more support members in a direction opposite to a side of the vehicle barrier apparatus that is intended to receive the impact from the oncoming vehicle, the kerb-abutment member configured to be urged against the kerb by the impact of the oncoming vehicle with the one or more barrier members and/or the one or more support members to prevent rotation of the support member to which the kerb abutment member is connected on said ground or floor surface and with respect to the kerb.

2. A vehicle barrier apparatus according to claim 1, at least one coupling member passing from at least one said support member to at least one other said support member thereby to couple separate said support members such that vehicular impact forces inducing movement in one coupled support member are transmissible to another coupled support member via the at least one coupling member;

wherein a said coupling member comprises two separated link portions joined by a rigid joining portion therebetween, whereby each one of the two link portions is coupled therethrough to a respective one of said two coupled support members.

3. A vehicle barrier apparatus according to claim 1 including two said kerb-abutment members each connected to a respective support member at opposite terminal ends of the vehicle barrier apparatus for placement alongside a respective one of two opposing kerbs.

4. A vehicle barrier apparatus according to claim 1 in which said kerb-abutment member extends laterally in opposite directions from the support member for placement alongside a kerb extending at opposite sides of the support member.

5. A vehicle barrier apparatus according to claim 1 in which said kerb-abutment member is detachably attachable to the support member.

6. A vehicle barrier apparatus according to claim 1 including a ground-insertion member extending transversely from the kerb-abutment member and adapted for insertion into a pre-formed opening within said ground or floor surface from a ground-facing side of the kerb-abutment member when the kerb-abutment member extends alongside the kerb.

7. A vehicle barrier apparatus according to claim 1 in which said kerb-abutment member comprises a linear tube of rigid material.

8. A vehicle barrier apparatus according to claim 1, wherein the one or more barrier members are one or more elongated barrier members pivotably connected to one of the one or more support members to be moveable about a pivot axis located within the support member from a stowed position to a deployed position;

and a said barrier member is upwardly inclined relative to the support member and the ground surface when in said deployed position.

9. A vehicle barrier apparatus according to claim 8 in which the one or more elongated barrier members terminates in a spike outwardly presented when said barrier member is in the deployed position.

10. A vehicle barrier apparatus according to claim 8 comprising a plurality of said elongated barrier members each independently pivotably connected to a said support member to be moveable independently about a respective pivot axis located within the support member from a stowed position to a deployed position.

11. A vehicle barrier apparatus according to claim 8 in which said pivot axis is located adjacent a longitudinal edge of the support member such that the barrier member extends therefrom in a direction over the support member towards an opposite longitudinal edge of the support member and terminates without extending over the opposite longitudinal edge when in the deployed position.

12. A vehicle barrier apparatus according to claim 8 in which the support member comprises a recess adapted to receive a said barrier member when in the stowed position.

13. A vehicle barrier apparatus according to claim 8 comprising a ramp member pivotably connected to a support member to be moveable about a pivot axis substantially parallel to a longitudinal edge of the support member from a stowed position to a deployed position of ground engagement thereby to define a ramp surface extending from the ground surface to an upper surface of the support member.

14. A vehicle barrier apparatus according to claim 8 including a removable cover member detachably attachable to the support member and dimensioned to house the salient parts of the barrier member when in the deployed position.

15. A vehicle barrier apparatus according to claim 14 in which the outer surface of the cover member is shaped to permit the cover member to fit within the reciprocally-shaped cavity space of another said cover member for stacking.

* * * * *